US011460215B2

(12) United States Patent
Minter et al.

(10) Patent No.: US 11,460,215 B2
(45) **Date of Patent: *Oct. 4, 2022**

(54) PRE-INSULATED DUCTWORK RAILING TECHNOLOGY

(71) Applicant: AQC Industries, LLC, Roseville, MN (US)

(72) Inventors: Sterling P. Minter, Pitman, NJ (US); James M. Lubratt, Shoreview, MN (US)

(73) Assignee: AQC INDUSTRIES, LLC, Roseville, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/138,021

(22) Filed: Dec. 30, 2020

(65) Prior Publication Data

US 2021/0116145 A1 Apr. 22, 2021

Related U.S. Application Data

(63) Continuation of application No. 16/252,145, filed on Jan. 18, 2019, now Pat. No. 10,895,399, which is a continuation-in-part of application No. 15/081,259, filed on Mar. 25, 2016, now Pat. No. 10,234,168.

(51) Int. Cl.
*F24F 13/02* (2006.01)

(52) U.S. Cl.
CPC ..... *F24F 13/0263* (2013.01); *F24F 13/0281* (2013.01); *F24F 13/0209* (2013.01)

(58) Field of Classification Search
CPC . F24F 13/0263; F24F 13/0281; F24F 13/0209
USPC ..... 138/109
See application file for complete search history.

(56) References Cited

U.S. PATENT DOCUMENTS

| | | | |
|---|---|---|---|
| 132,475 | A | 10/1872 | Linville |
| 1,916,908 | A | 7/1933 | Stacey, Jr. et al. |
| 2,353,883 | A | 7/1944 | Dickey |
| 2,498,753 | A | 2/1950 | Deitsch |
| 2,917,083 | A | 12/1959 | Duvall et al. |
| 2,956,587 | A | 10/1960 | Fisher |

(Continued)

FOREIGN PATENT DOCUMENTS

FR 2238022 A1 2/1975

OTHER PUBLICATIONS

"3M VentureClad Insulation Jacketing Tapes: 1577 Series," Technical Data, 3M Co.pany, Dec. 2015 4 pages.

(Continued)

*Primary Examiner* — Craig M Schneider
*Assistant Examiner* — David R Deal
(74) *Attorney, Agent, or Firm* — Fredrikson & Byron, P.A.

(57) ABSTRACT

The invention provides a pre-insulated duct having a length and comprising a tube having a foam layer. The pre-insulated duct has an interior face and an exterior face and a thickness defined as a distance between the interior face and the exterior face. The interior face of the pre-insulated duct bounds an airflow space. In the present group of embodiments, the pre-insulated duct has a mounting rail system extending along the length of the pre-insulated duct. The mounting rail system includes at least one mounting rail, and preferably a plurality of mounting rails, positioned on (e.g., positioned on an exterior of) the pre-insulated duct.

29 Claims, 14 Drawing Sheets

(56) References Cited

U.S. PATENT DOCUMENTS

| | | | |
|---|---|---|---|
| 3,212,529 | A | 10/1965 | Ullman et al. |
| 3,251,382 | A | 5/1966 | Tatsch |
| 3,543,804 | A | 12/1970 | Ziegler |
| 3,630,549 | A | 12/1971 | Grimm |
| 3,687,168 | A | 8/1972 | Sherman et al. |
| 3,776,253 | A | 12/1973 | Yamaguchi et al. |
| 3,889,581 | A | 6/1975 | Bray, Sr. |
| 4,249,578 | A | 2/1981 | Freeman |
| 4,398,564 | A | 8/1983 | Young et al. |
| 4,596,095 | A | 6/1986 | Chalfant |
| 4,603,247 | A | 7/1986 | Foley et al. |
| 5,918,644 | A | 7/1999 | Haack et al. |
| 5,944,060 | A | 8/1999 | Mackay |
| 6,116,833 | A | 9/2000 | Ellis |
| 6,203,074 | B1 | 3/2001 | Daniel |
| 6,360,783 | B2 | 3/2002 | Faverio et al. |
| 6,716,520 | B2 | 4/2004 | Cook |
| 6,763,853 | B1 | 7/2004 | Redding et al. |
| 6,901,969 | B2 | 6/2005 | Siiter |
| 7,044,171 | B2 | 5/2006 | Betley et al. |
| 7,624,762 | B2 | 12/2009 | Cohen et al. |
| 7,699,078 | B1 | 4/2010 | Husmann, Jr. |
| 7,712,787 | B2 | 5/2010 | Vincenti |
| 7,744,134 | B2 | 6/2010 | Dingley |
| 7,757,722 | B1 | 7/2010 | Lesch, Jr. et al. |
| 8,667,995 | B1 | 3/2014 | Fanelli |
| 8,733,749 | B2 | 5/2014 | Lanciaux |
| 9,074,788 | B2 | 7/2015 | Duffy |
| 9,114,579 | B2 | 8/2015 | Lanciaux |
| 9,200,815 | B2 | 12/2015 | Fleagle et al. |
| 9,476,525 | B2 | 10/2016 | Tarpy et al. |
| 9,816,644 | B2 | 11/2017 | Tarpy et al. |
| 9,840,050 | B2 | 12/2017 | Lanciaux |
| 9,840,051 | B2 | 12/2017 | Lanciaux |
| 9,995,503 | B2 | 6/2018 | Lanciaux |
| 10,234,168 | B2 * | 3/2019 | Minter ..... F24F 13/0281 |
| 2003/0011290 | A1 | 1/2003 | Austin et al. |
| 2003/0051764 | A1 | 3/2003 | Jungers |
| 2006/0083889 | A1 | 4/2006 | Schuckers |
| 2008/0045137 | A1 | 2/2008 | Rosal |
| 2011/0030833 | A1 | 2/2011 | Griggio |
| 2013/0074947 | A1 | 3/2013 | Dal Canto et al. |
| 2013/0118627 | A1 | 5/2013 | Utay |
| 2014/0345735 | A1 | 11/2014 | Hobbs |
| 2015/0267937 | A1 | 9/2015 | Duffy |
| 2017/0276394 | A1 | 9/2017 | Minter et al. |
| 2018/0216844 | A1 | 8/2018 | Wasniewski |
| 2018/0320921 | A1 | 11/2018 | Combs |

OTHER PUBLICATIONS

"PalDuct Phenolic System," Product Catalogue, Kingspan, Issue 1, Apr. 2015, 10 pages.

Jamestown 2017 Outdoor Duct Installation, Photographs, 10 pages.

English Human Translation of French Publication No. 2238022 A1, published Feb. 14, 1975, 3 pages.

* cited by examiner

PRE-INSULATED DUCTWORK RAILING TECHNOLOGY

RELATED APPLICATION

This is a continuation of U.S. Ser. No. 16/252,145, entitled "Pre-Insulated Ductwork Railing Technology," filed Jan. 18, 2019, which is a continuation-in-part of U.S. Ser. No. 15/081,259, entitled "Multi-Tube Offset Pre-Insulated HVAC Ducting Technology," filed Mar. 25, 2016, the entire contents of which are incorporated herein by reference.

FIELD OF THE INVENTION

The present invention relates generally to HVAC ducts. More particularly, this invention relates to pre-insulated HVAC ducts.

BACKGROUND OF THE INVENTION

Conventional HVAC ductwork has a variety of limitations. It may have suboptimal thermal insulation properties and/or be non-uniform in terms of thermal insulation properties over its length. In some cases, there may be more air and/or water leakage than is desired. Further, certain ductwork systems include materials that are ideally not exposed to the air circulated within a building. Still further, conventional ductwork may not be as durable as would be optimal. Moreover, some HVAC ductwork is heavy, expensive, or difficult to install. With respect to outdoor ductwork, which is just one relevant category of HVAC ductwork, some ducts are not pre-insulated, and may therefore necessitate having an insulation subcontractor apply thermal insulation to the installed ductwork. Furthermore, it can be inconvenient or difficult to securely mount HVAC ductwork in desired positions and/or to mount components to such ductwork.

It would be desirable to provide a duct construction (e.g., a duct), a ductwork assembly, and a ductwork system that address one or more of the foregoing problems associated with conventional ductwork.

SUMMARY OF THE INVENTION

Figure 1:
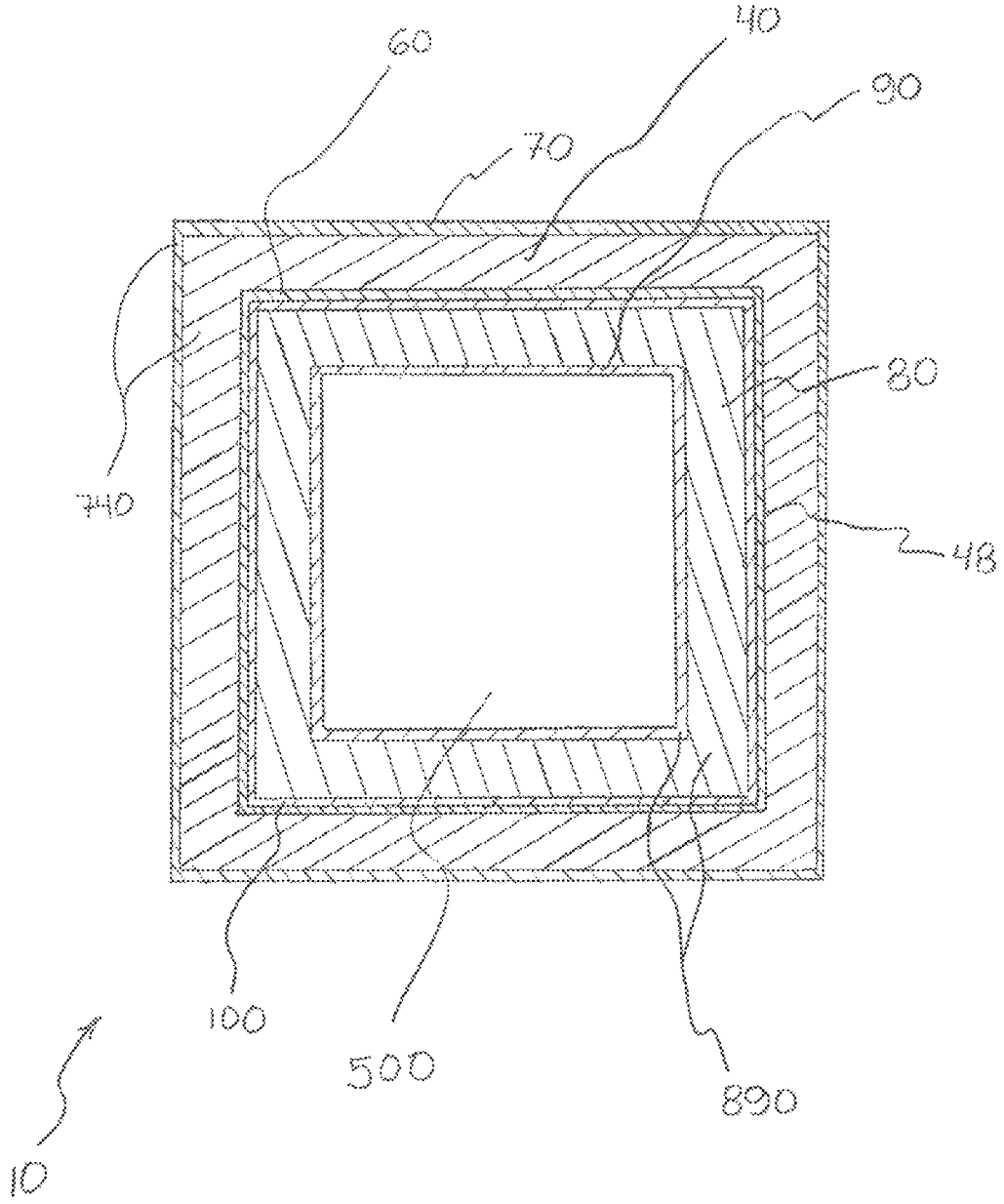
FIG. 1 is a cross-sectional view of a duct in accordance with certain embodiments of the present invention.

In some embodiments, the invention provides an HVAC duct having opposed first and second ends and a central span extending between the first and second ends. The HVAC duct includes an inner composite tube and an outer composite tube. The inner composite tube has an interior metal wall, a primary foam wall, and an exterior metal wall. The primary foam wall is bonded to both the interior and exterior metal walls of the inner composite tube. The outer composite tube has an interior metal wall, a secondary foam wall, and an exterior metal wall. The secondary foam wall is bonded to both the interior and exterior metal walls of the outer composite tube. The inner composite tube is nested inside the outer composite tube in an end-offset configuration characterized by the inner composite tube projecting axially beyond the outer composite tube at the first end of the duct, whereas at the second end of the duct the outer composite tube projects axially beyond the inner composite tube. Thus, the first end of the duct defines a male detent having a radially-outward-facing metal engagement face projecting axially beyond the interior metal wall of the outer composite tube, whereas the second end of the duct defines a female detent having a radially-inward-facing metal engagement face projecting axially beyond the exterior metal wall of the interior composite tube.

Certain embodiments of the invention provide an HVAC ductwork assembly comprising a first duct and a second duct. The first duct has opposed first and second ends and a central span extending between the first and second ends. The first duct includes an inner composite tube and an outer composite tube. The inner composite tube has an interior metal wall, a primary foam wall, and an exterior metal wall. The primary foam wall is bonded to the interior and exterior metal walls of the inner composite tube. The outer composite tube has an interior metal wall, a secondary foam wall, and an exterior metal wall. The secondary foam wall is bonded to both the interior and exterior metal walls of the outer composite tube. The inner composite tube is nested inside the outer composite tube in an end-offset configuration characterized by the inner composite tube projecting beyond the outer composite tube at the first end of the first duct, whereas at the second end of the first duct the outer composite tube projects beyond the inner composite tube. Thus, the first end of the first duct defines a male detent having a radially-outward-facing metal engagement face projecting axially beyond the interior metal wall of the outer composite tube of the first duct, whereas the second end of the first duct defines a female detent having a radially-inward-facing metal engagement face projecting axially beyond the exterior metal wall of the inner composite tube of the first duct. The second duct has opposed first and second ends and a central span extending between the first and second ends. The second duct includes an inner composite tube and an outer composite tube. The inner composite tube has an interior metal wall, a primary foam wall, and an exterior metal wall. The primary foam wall is bonded to the interior and exterior metal walls of the inner composite tube. The outer composite tube has an interior metal wall, a secondary foam wall, and an exterior metal wall. The secondary foam wall is bonded to the interior and exterior metal walls of the outer composite tube. The inner composite tube is nested inside the outer composite tube in an end-offset configuration characterized by the inner composite tube projecting beyond the outer composite tube at the first end of the second duct, whereas at the second end of the second duct the outer composite tube projects beyond the inner composite tube. Thus, the first end of the second duct defines a male detent having a radially-outwardly-facing metal engagement face projecting axially beyond the interior metal wall of the outer composite tube, whereas the second end of the second duct defines a female detent having a radially-inwardly-facing metal engagement face projecting axially beyond the exterior metal wall of the inner composite tube. In the present embodiments, the first duct and the second duct are joined together by a connection characterized by the male detent of the first duct being received in the female detent of the second duct, such that the exterior metal wall of the inner composite tube of the first duct is nested inside, so as to contact, the interior metal wall of the outer composite tube of the second duct.

In certain embodiments, the invention provides an HVAC duct having opposed first and second ends and a central span extending between the first and second ends. The HVAC duct includes an inner composite tube, an outer composite tube, and an outermost composite tube. The inner composite tube has an interior metal wall, a primary foam wall, and an exterior metal wall. The primary foam wall is bonded to both the interior and exterior metal walls of the inner composite tube. The outer composite tube has an interior metal wall, a secondary foam wall, and an exterior metal wall. The secondary foam wall is bonded to both the interior and exterior metal walls of the outer composite tube. The outermost composite tube has an interior metal wall, a tertiary foam wall, and an exterior metal wall. The tertiary foam wall is bonded to both the interior and exterior metal walls of the outermost composite tube. The inner composite tube is nested inside the outer composite tube, and the outer composite tube is nested inside the outermost composite tube. These three composite tubes are secured in an end-offset configuration characterized by a desired one of the three composite tubes projecting axially beyond the other two of the three composite tubes at the first end of the duct, whereas at the second end of the duct the other two of the three composite tubes project axially beyond the desired one of the three composite tubes. Thus, a leading one of the first and second ends of the duct defines a male detent, while a trailing one of the first and second ends of the duct defines a female detent. The male detent includes a radially-outward-facing metal engagement face. The female detent includes a radially-inward-facing metal engagement face. In some the present embodiments, the female detent includes an axially-outward-facing open pocket surrounded by the radially-inward-facing metal engagement face. Preferably, two of the three composite tubes are in flush-end positions characterized by those two composite tubes being substantially flush with each other at both the first and second ends of the duct. In some cases, the HVAC duct is part of an HVAC ductwork assembly that further includes another duct (these two ducts being defined as first and second ducts). In such cases, the first and second ducts are joined together by a connection characterized by the male detent being received in the female detent such that the radially-outward-facing metal engagement face of the male detent is nested inside, so as to contact, the radially-inward-facing metal engagement face of the female detent.

In one group of embodiments, the invention provides a pre-insulated duct having a length and comprising a tube having a foam layer. In some cases, the duct has two opposed ends, and the tube is centered on a longitudinal axis on which both of the opposed open ends are also centered. The pre-insulated duct has an interior face and an exterior face and a thickness defined as a distance between the interior face and the exterior face. The interior face of the pre-insulated duct bounds an airflow space. In the present group of embodiments, the pre-insulated duct has a mounting rail system extending along the length of the pre-insulated duct. The mounting rail system includes at least one mounting rail, and preferably a plurality of mounting rails, positioned on (e.g., positioned on an exterior of) the pre-insulated duct.

In some embodiments of the present group, the mounting rails are on multiple sides (e.g., on the exterior of multiples sides) of the pre-insulated duct. In addition, on each side of the duct that has one or more mounting rails, there may optionally be only a single rail line extending along the length of the pre-insulated duct.

In any embodiment of the present group, the pre-insulated duct preferably has a plurality of internal braces that are located in the airflow space and that are spaced-apart from one another along the length of the pre-insulated duct. In such cases, each of the mounting rails preferably is attached to the plurality of internal braces at locations spaced-apart along the length of the pre-insulated duct. When provided, the internal braces can optionally have at least first and second rods that are crosswise to each other.

For embodiments wherein the internal braces are provided, each of the mounting rails can optionally be attached to the plurality of internal braces, at locations spaced-apart along the length of the pre-insulated duct, by a plurality of traversal linkage pins that each extend through the thickness of the pre-insulated duct so as to project through the foam layer. When provided, each of the hybrid linkage pins can optionally be: (i) received in a linkage bore formed in the foam layer, and (ii) attached at one end to one of the mounting rails and attached at an opposite end to one of the internal braces.

Certain embodiments of the invention provide a pre-insulated duct having a length and comprising a tube having a foam layer. In the present embodiments, the pre-insulated duct has an interior face and an exterior face and a thickness defined as a distance between the interior face and the exterior face. The interior face of the pre-insulated duct bounds an airflow space. In the present embodiments, the pre-insulated duct includes (e.g., has) four sides and has opposed open ends. The pre-insulated duct has a mounting rail system extending along the length of the pre-insulated duct. In the present embodiments, the mounting rail system includes mounting rails that are positioned on only two of the four sides of the pre-insulated duct. Preferably, the two sides on which the mounting rails are positioned are opposed sides of the pre-insulated duct. In some of the present embodiments, on each of the two sides on which the mounting rails are positioned, there is only a single rail line extending along the length of the pre-insulated duct. In the present embodiments, the tube preferably is centered on a longitudinal axis on which both of the opposed open ends are also centered. In some cases, each of the mounting rails is positioned so as to be at least generally parallel to the longitudinal axis. Furthermore, the pre-insulated duct of the present embodiments preferably has a plurality of internal braces that are located in the airflow space and that are spaced-apart from one another along the length of the pre-insulated duct, and each of the mounting rails preferably is attached to the plurality of internal braces at locations spaced-apart along the length of the pre-insulated duct. When provided, the internal braces can optionally have at least first and second rods that are crosswise to each other.

For the embodiments just described wherein internal braces are provided, each of the mounting rails preferably is attached to the plurality of internal braces, at locations spaced-apart along the length of the pre-insulated duct, by a plurality of traversal linkage pins that each extend through the thickness of the pre-insulated duct so as to project through the foam layer. When provided, each of the hybrid linkage pins can optionally be: (i) received in a linkage bore formed in the foam layer, and (ii) attached at one end to one of the mounting rails and attached at an opposite end to one of the internal braces.

DETAILED DESCRIPTION OF PREFERRED EMBODIMENTS

The following detailed description is to be read with reference to the drawings, in which like elements in different drawings have like reference numerals. The drawings, which are not necessarily to scale, depict selected embodiments and are not intended to limit the scope of the invention. Skilled artisans will recognize that the examples provided herein have many useful alternatives that fall within the scope of the invention.

The invention provides a pre-insulated HVAC duct that has exceptional thermal insulation properties and durability. In addition, the duct has an extremely light weight composition, and it has a special multi-tube, multi-wall construction that offers numerous advantages.

Figure 2:
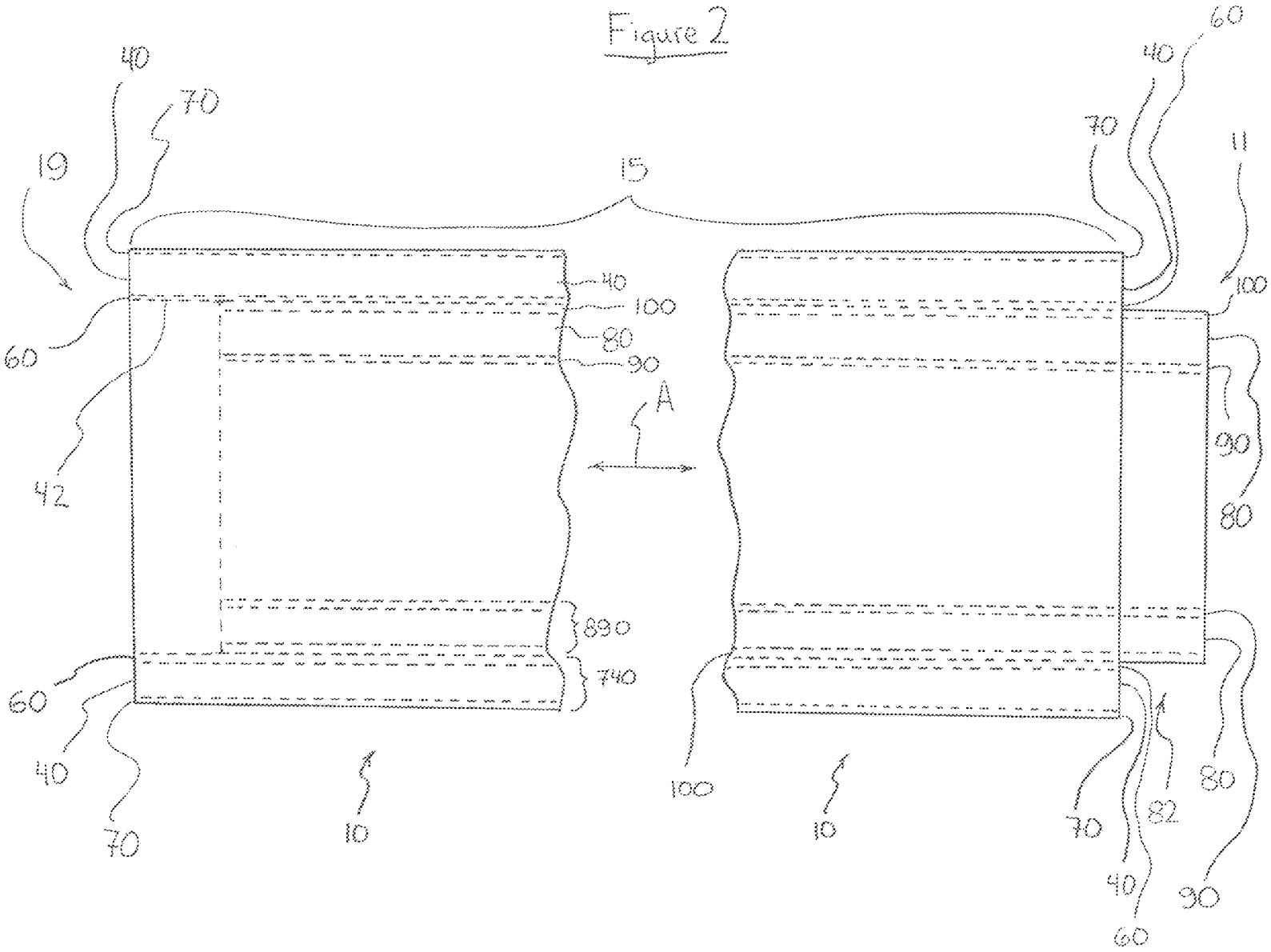
FIG. 2 is a broken-away side view of the duct of FIG. 1.

As shown in FIG. 2, the duct 10 has opposed first 11 and second 19 ends and a central span 15 extending therebetween. The length of the duct 10 can be varied to accommodate the requirements of different applications. Typically, the duct 10 will have a length of between 1 and 18 feet. In some cases, the length is between 3 and 13 feet. The duct 10 may, for example, have a length of about 4 feet, about six feet, about 8 feet, about 10 feet, or about 12 feet. These examples are by no means limiting. In other embodiments, the duct 10 has a length of between 3 inches and 2 feet, such as between 4 inches and 1.5 feet. In such embodiments, the duct 10 may, for example, have a length of about 6 inches or about one foot.

The duct 10 includes an inner composite tube 890 and an outer composite tube 740. The inner composite tube 890 has an interior metal wall 90, a primary foam wall 80, and an exterior metal wall 100. The primary foam wall 80 is bonded to both the interior 90 and exterior 100 metal walls of the inner composite tube 890. In the present disclosure, the term bonded is used to refer to two walls that are integrally affixed to each other by chemical, adhesive, and/or mechanical means. Thus, the interior metal wall 90, primary foam wall 80, and exterior metal wall 100 of the inner composite tube 890 collectively form a single unitary multi-wall tube 890.

The outer composite tube 740 has an interior metal wall 60, a secondary foam wall 40, and an exterior metal wall 70. The secondary foam wall 40 is bonded to both the interior 60 and exterior 70 metal walls of the outer composite tube 740. Thus, the interior metal wall 60, secondary foam wall 40, and exterior metal wall 70 collectively form a single unitary multi-wall tube 740.

Each metal wall of the duct 10 preferably has a thickness of between 10 micrometers and 2,600 micrometers, such as between 15 micrometers and 300 micrometers. The metal walls of the duct 10 need not all have the same thickness. In one non-limiting example, metal wall 90 has a thickness of about 60 micrometers, and metal wall 100 has a thickness of about 200 micrometers. In addition, metal wall 60 can optionally have a thickness in the range of 50-90 micrometers, while metal wall 70 has a thickness in the range of 50-250 micrometers. In one non-limiting example, metal wall 60 has a thickness of about 60 micrometers, while metal wall 70 has a thickness of about 60 micrometers. In another non-limiting example, metal wall 60 has a thickness of about 80 micrometers, while metal wall 70 has a thickness of about 80 micrometers. In still another non-limiting example, metal wall 60 has a thickness of about 60 micrometers, while metal wall 70 has a thickness of about 200 micrometers.

The inner composite tube 890 is nested inside the outer composite tube 740 in an end-offset configuration characterized by the inner composite tube projecting axially beyond the outer composite tube at the first end 11 of the duct 10, whereas at the second end 19 of the duct the outer composite tube projects axially beyond the inner composite tube. This can be appreciated by referring to FIG. 2. Here, the first end 11 of the duct 10 defines a male detent having a radially-outward-facing metal engagement face 82 projecting axially beyond the interior metal wall 60 of the outer composite tube 740, whereas the second end 19 of the duct defines a female detent having a radially-inward-facing metal engagement face 42 projecting axially beyond the exterior metal wall 100 of the inner composite tube 890.

The inner composite tube 890 is nested inside the outer composite tube 740 (e.g., by virtue of a friction-fit, glue, tape, and/or mechanical fastener assembly) such that the exterior metal wall 100 of the inner composite tube and the interior metal wall 60 of the outer composite tube contact each other. A preferred concentric nesting arrangement can be appreciated by referring to FIGS. 1-3. Here, it is to be appreciated that the inner composite tube 890 and the outer composite tube 740 preferably are affixed to each other so as to be locked against relative axial or rotational movement relative to each other.

Figure 4:
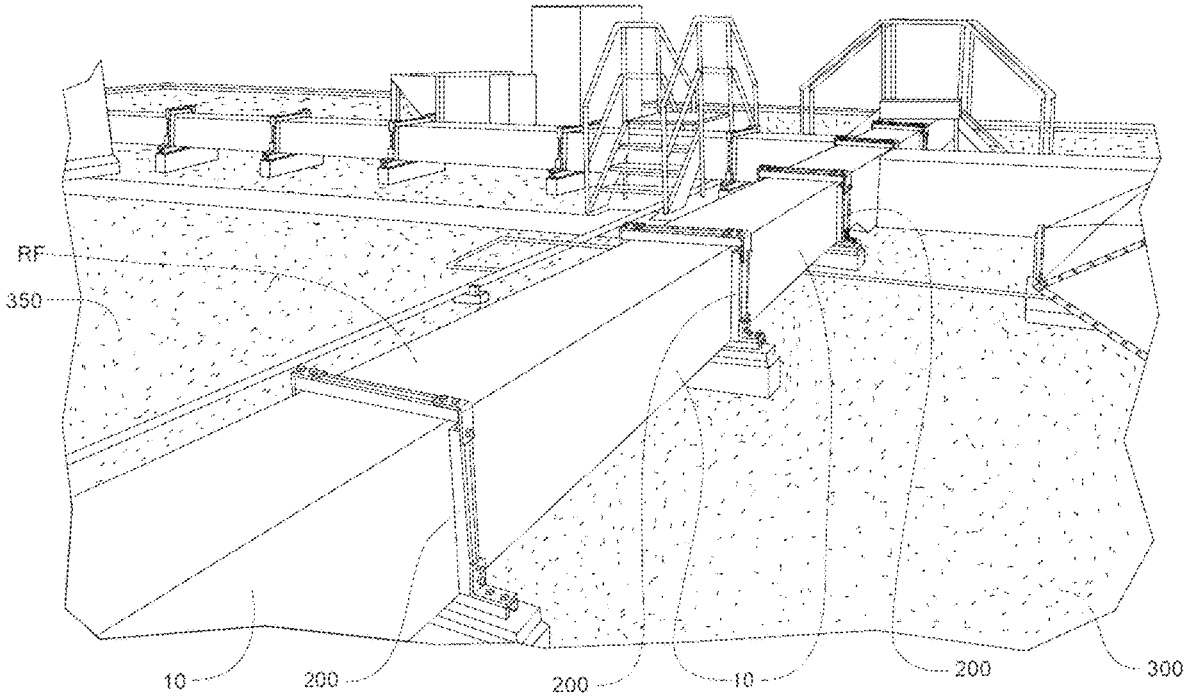
FIG. 4 is a perspective view of a building provided with an outdoor ductwork system in accordance with certain embodiments of the invention.
Figure 5:
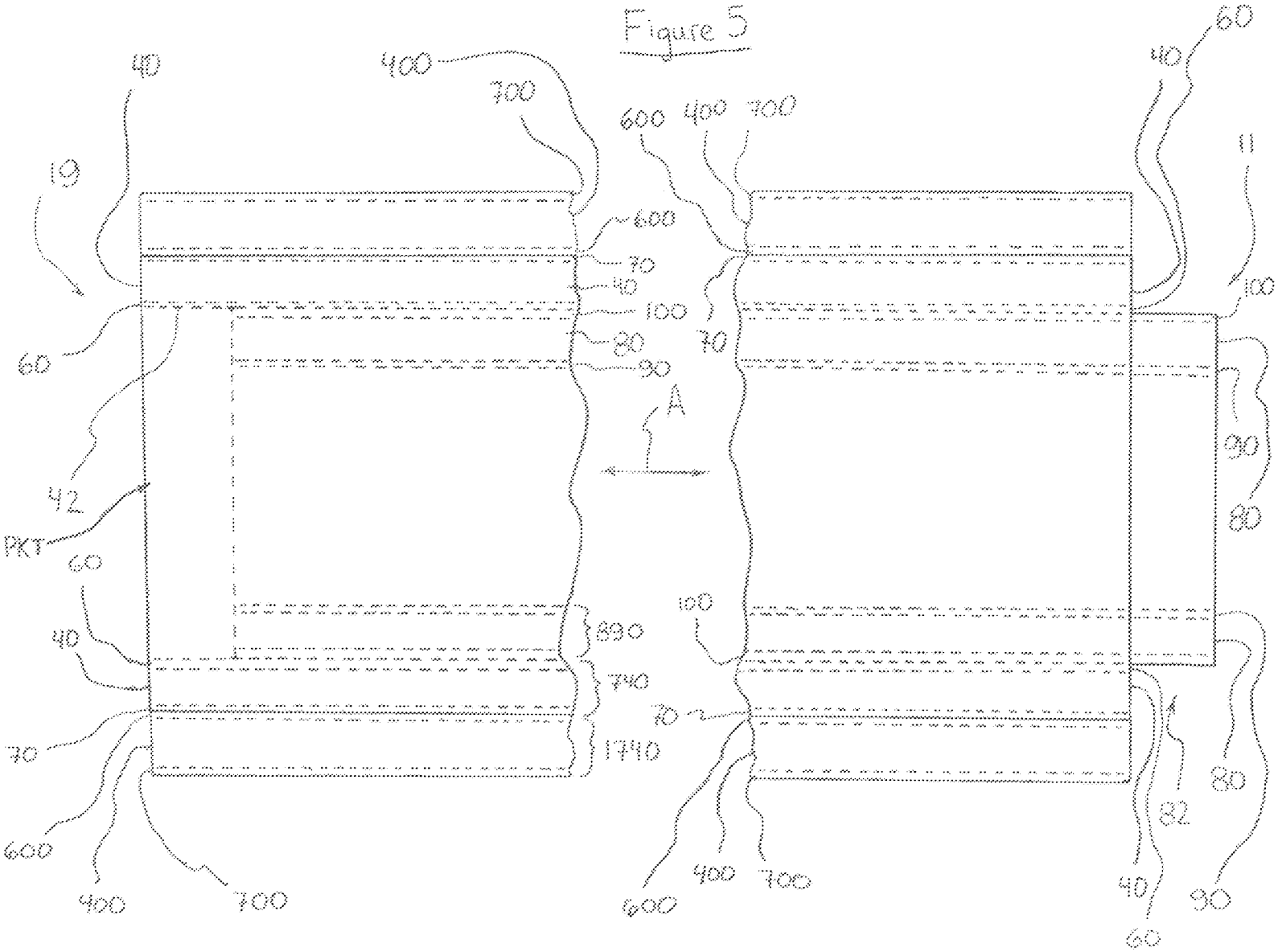
FIG. 5 is a broken-away side view of a duct in accordance with certain embodiments of the invention.

The duct 10 is elongated along a longitudinal axis, which is depicted in FIGS. 2 and 5 by two-sided arrow A. In the embodiments of FIGS. 1 and 4, the inner composite tube 890 and the outer composite tube 740 each have a square or rectangular configuration in a cross-section taken perpendicular to the longitudinal axis A of the duct 10. In other embodiments, the inner composite tube and the outer composite tube each have a circular configuration in a cross-section taken perpendicular to the longitudinal axis of the duct.

Figure 7B:
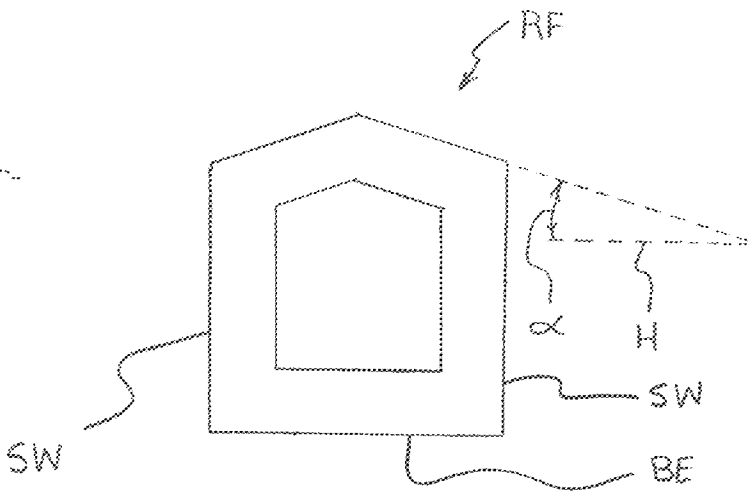
FIG. 7B is a schematic end view of a duct in accordance with other embodiments of the present invention.
Figure 7A:
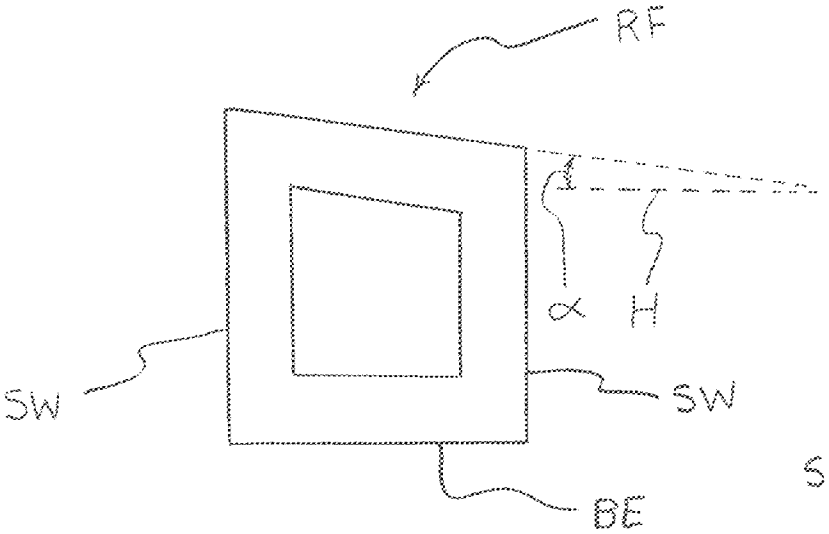
FIG. 7A is a schematic end view of a duct in accordance with certain embodiments of the present invention.

FIGS. 7A and 7B schematically depict two non-limiting embodiments wherein the duct 10 has a sloped roof RF. Here, the roof RF of the duct 10 is intended to define the top (i.e., the upwardly facing side) of the duct 10 when installed in its operative position as part of a ductwork system. The upward orientation of a duct roof RF can be appreciated with reference to FIG. 4. Note that the duct roof shown in FIG. 4 is not sloped, but rather is parallel to the duct base and to a horizontal axis.

A sloped (or "inclined") duct roof RF can provide advantageous levels of watershed, e.g., of rain or other precipitation in cases where the duct is mounted outdoors. In the embodiment of FIG. 7A, the roof RF has a single face extending (at a constant angle α) entirely between the two sides SW of the duct 10. In the embodiment of FIG. 7B, the roof RF has two faces each extending at an angle α relative to a horizontal axis H. Thus, the duct roof RF can optionally have a gable. In embodiments where the duct roof includes at least one sloped face, the noted angle α can be varied to accommodate different applications. The angle (or "pitch") may range, for example, from about 5 to about 30 degrees. It is to be appreciated that while certain embodiments provide the duct with a sloped roof, this is by no means required.

With continued reference to FIGS. 7A and 7B, it can be appreciated that, in certain embodiments, the duct 10 includes a roof RF, base BE, and two sides SW. Here, the roof RF and base BE are generally opposed; the same is true of the two illustrated sides SW. The base BE of the duct 10 is intended to define the bottom (i.e., the downwardly facing side) of the duct when installed in its operative position as part of a ductwork system.

While not strictly required, the inner composite tube 890 preferably has substantially the same length as the outer composite tube 740. The term "substantially the same" as used herein means no more than 10% different. It is to be understood that the inner 890 and outer 740 composite tubes of the duct 10 can in some cases initially have lengths that differ by more than 10%. In such cases, however, one or both of these tubes would typically be cut down, or "trimmed," such that the two resulting trimmed tubes have the same length. In many cases, it will be preferred that all the tubes of the duct 10 be of identical length, or at least within 5% of each other, at least once two such ducts are connected (e.g., in embodiments where two such ducts are operably connected to each other, as in FIG. 3).

Referring to FIG. 2, the interior metal wall 90, primary foam wall 80, and exterior metal wall 100 of the inner composite tube 890 preferably all have substantially the same length. In addition, the interior metal wall 60, secondary foam wall 40, and exterior metal wall 70 preferably all have substantially the same length. One advantage of such arrangements is that the duct 10 has a continuous interior metal facing. Thus, metal can define the entire interior surface area that will be exposed to air flowing through the interior passage 500 of the duct 10.

Figure 3:
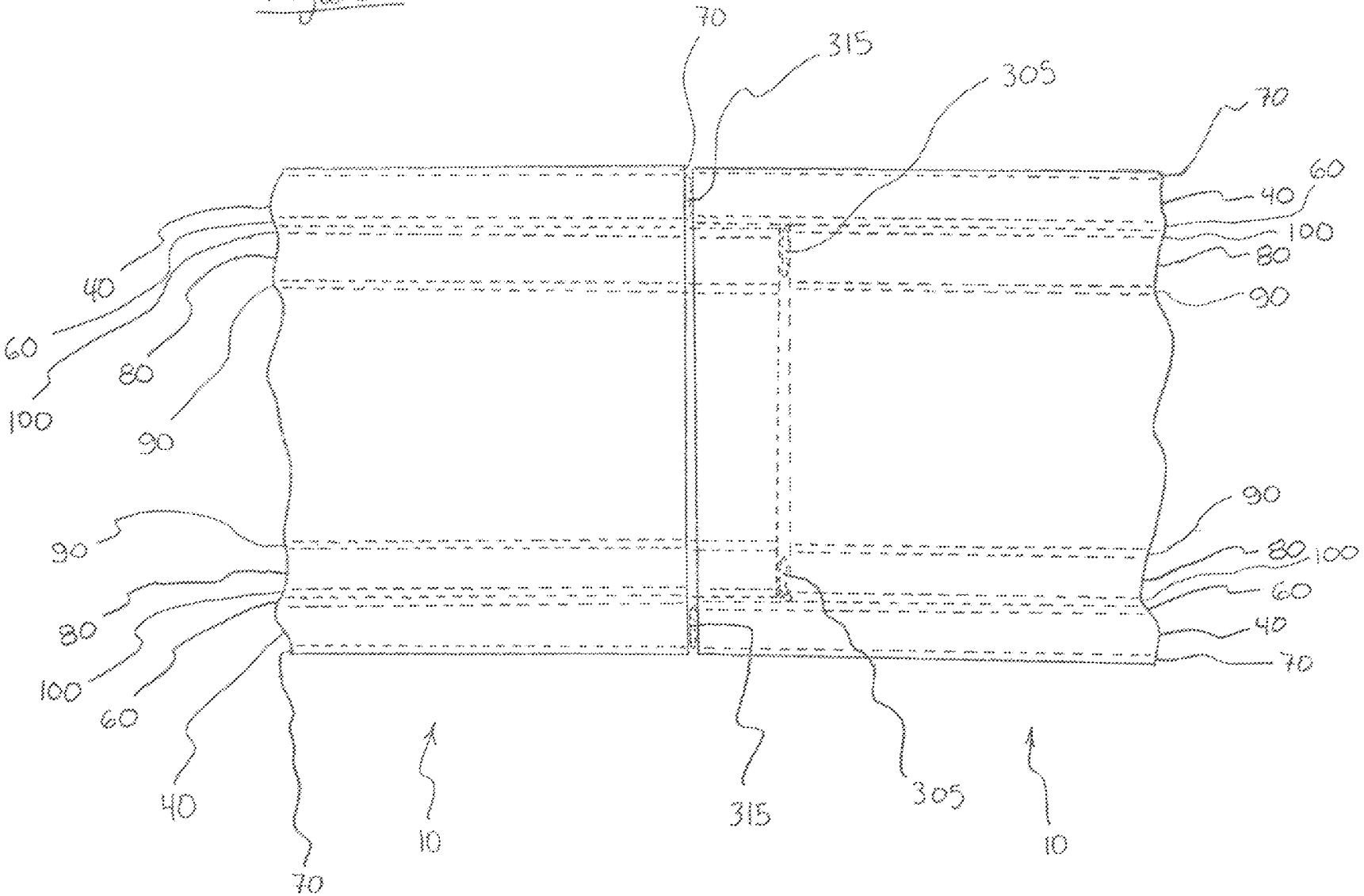
FIG. 3 is a broken-away side view of a connection between two ducts in accordance with certain embodiments of the invention.

In FIGS. 1-3, between the innermost metal facing 90 and the outermost metal facing 70 there are two separate layers of foam. Each of these foam layers provides a thermal break, e.g., through which there is no thermal pathway defined by metal connecting the innermost 90 and outermost 70 metal walls.

The walls of the duct 10 desirably are devoid of microfibers. Preferably, the entire duct 10 is devoid of microfibers. In addition, the walls of the duct 10 desirably are devoid of both CFC (i.e., chlorofluorocarbon) and HCFC (i.e., hydrochlorofluorocarbon). Preferably, the entire duct 10 is devoid of both CFC and HCFC.

The foam walls of the duct 10 are self-supporting and preferably are rigid (i.e., not capable of being wound). They preferably comprise a polymer foam. In preferred embodiments, phenolic foam is used, although polyurethane foam or other types of rigid foam can alternatively be used.

The foam walls of the duct 10 preferably each have a thickness in the range of 10-100 mm, such as 15-60 mm. In one non-limiting example, the foam walls each have a thickness of about 20 mm. In another non-limiting example, the foam walls each have a thickness of about 30 mm. In still another non-limiting example, the foam walls each have a thickness of in the range of about 40-45 mm.

In the embodiment of FIG. 2, the duct 10 includes six walls 40, 60, 70, 80, 90, 100. Preferably, four of the walls 60, 70, 90, 100 are metal while two other walls 40, 80 comprise a polymer foam. In FIG. 2, the duct 10 has, moving in a radially outward direction from the longitudinal axis of the duct, no more than two foam walls (i.e., no more than two layers of foam) and no more than four rigid metal walls (i.e., no more than four rigid layers of metal).

In other embodiments, the duct includes nine walls. Reference is made to the embodiment of FIG. 5. Preferably, six of the walls 60, 70, 90, 100, 600, 700 are metal while three other walls 40, 80, 400 comprise a polymer foam. In FIG. 5, the duct 10 has, moving in a radially outward direction from the longitudinal axis of the duct, no more than three foam walls (i.e., no more than three layers of foam) and no more than six rigid metal walls (i.e., no more than six rigid layers of metal).

The foam walls may, for example, comprise (or consist of, or at least consist essentially of) a phenolic resin.

In addition to the noted foam walls and metal walls, the duct 10 can optionally have an outer jacketing material. In some embodiments, the jacketing material forms a vapor barrier that envelopes the entire perimeter, and the entire length, of the duct 10. The jacketing material can be a multi-layer laminate that includes an adhesive facing (e.g., a layer of acrylic adhesive). In the embodiment of FIG. 1, the optional jacketing material can be adhesively applied over the exterior metal wall 70 of the outer composite tube 740. In the embodiment of FIG. 5, the optional jacketing material can be adhesively applied over the exterior metal wall 700 of the outermost composite tube 1740. One useful jacketing material is the 3M™ VentureClad™ 1577 CW Insulation Jacketing, which is sold commercially by 3M of St. Paul, Minn. In other embodiments, the jacketing material simply comprises a plastic liner, which may envelope the entire perimeter, and the entire length, of the duct 10.

Preferably, each of the duct's metal walls comprises aluminum. While aluminum is preferred, another aircraft metal can alternatively be used. The aircraft metal can be selected from the group consisting of aluminum, titanium, beryllium, magnesium, and alloys comprising one or more of these metals. In other cases, steel may be used.

In certain embodiments, the inner composite tube 890 has metal interior 90 and exterior 100 walls, while the outer composite tube 740 has paper or cardboard liner in place of the metal interior wall 60 and/or in place of the metal exterior wall 70. In embodiments where the duct 10 includes three composite tubes 890, 740, 1740, the outermost composite tube 1740 can optionally have paper or cardboard liner in place of the metal wall 600 and/or in place of metal wall 700.

The foam layers of the duct 10 can optionally have a density in the range of from 40 to 80 kg/m$^3$, such as in the range of from 50-70 kg/m$^3$. In one non-limiting example, the density is about 60 kg/m$^3$.

In preferred embodiments, the interior metal wall 90, the primary foam wall 80, and the exterior metal wall 100 of the inner composite tube 890, as well as the interior metal wall 60, the secondary foam wall 40, and the exterior metal wall 70 of the outer composite tube 740, all have substantially the same length. In many cases, these four walls will all have the same length, or at least be within 5% of one another. This will typically be the case once two ducts 10 are connected, such as in embodiments that provide two such ducts operably connected to each other. Reference is made to FIG. 3.

The present duct 10 provides exceptional thermal insulation properties. For example, the duct 10 preferably has an R value of at least 6. In some embodiments, the R value is at least 8. In one non-limiting example, the R value is about 10. In other embodiments, the R value is at least 11. In one non-limiting example, the R value is about 12. In still other embodiments, the R value is at least 14. In one non-limiting example, the R value is about 15. In another non-limiting example, the R value is about 18. The R value of the present duct can be determined using conventional methodology, e.g., in accordance with the well-known ASTM C518 standard for measuring R value, the salient teachings of which are incorporated herein by reference.

In addition to providing exceptional thermal insulation, the present HVAC duct 10 has an advantageous light-weight construction. Preferably, the duct 10 has a weight per unit surface area of less than 3 pounds per square foot of surface area. In some embodiments, the duct 10 has a weight per unit surface area of less than 2 pounds per square foot of surface area. In one non-limiting example, the duct has a weight per unit surface area of about 1.1 pound per square foot of surface area.

One non-limiting method of making the duct will now be described. The duct, as shown on a set of mechanical plans designed by a building engineer, is electronically traced with a CAD (Computer Aided Design) software package, such as that available commercially from AutoDesk under the name of Estimator MEP. The software has been programmed to calculate the amount and configuration of duct panels to be used to make the designed ductwork. Suitable duct panels are available commercially from PAL System International FZCO, of Dubai, U.A.E., e.g., under the tradename Kingspan PalDuct Phenolic panels. The program will output a bill of material that is then programmed into a "SuperCut" software system that is designed to optimize the duct panels for minimal waste of product to produce a projects ductwork. The SuperCut program also controls a CNC (Computer Numerically Controlled) machine. The CNC machine can be, for example, obtained commercially from Alarsis Corte Industrial S.L., of Murcia Spain. The CNC machine has a cutting blade that operates in 5 axes: depth, width, length, blade angle and blade rotation. The CNC machine will follow the program to cut the duct panels as needed to manufacture the duct system. If a duct is of a size where multiple walls of the duct can be used from one panel, the panel will be cut in two (2) 45 degree cuts that form a "V" cut where the bottom aluminum liner is not cut. This allows the panel to be folded from a flat panel into a rectangular duct system. With respect to ducts of larger size that require the side walls to each be made from a different panel, the CNC machine will cut a 45 degree bevel cut and will cut through the bottom aluminum liner. Then the multiple panels each having a 45 degree bevel cut will be assembled into a rectangular duct.

Once one duct (i.e., the interior composite tube 890) is assembled, the CNC machine is programmed to make a $2^{nd}$ duct (i.e., the outer composite tube 740) such that the inside dimensions exactly match the outside dimension of the inside duct. The $2^{nd}$ duct is then manufactured around an inside duct in such a manner that the inside duct protrudes at one end by about 3" (male end) and the exterior duct protrudes by 3" (female end) on the other end of the duct. The two ducts can be connected by friction fit, sealant, glue, and/or double side tape. The exterior duct is then covered with a plastic liner to protect the duct from visible damage, hail, and/or other items that could dent the outer duct. This plastic liner is applied with a double sided tape. The duct with the plastic liner is then wrapped with the 3M VentureClad 1577 product to complete an air-and-water-tight outer jacketing for the duct system. The VentureClad has a self-adhesive backing to adhere it to the plastic liner. It is to be appreciated that this method is merely exemplary; the foregoing details are by no means limiting to the invention. Other methods can be used to manufacture the various duct embodiments described herein.

The invention also provides embodiments wherein two ducts 10 in accordance with the invention are operably connected to each other. Reference is made to FIG. 3. While FIG. 3 shows the connection between two ducts that each have only two composite tubes 890, 740, the following discussion also applies to the connection between two ducts that each include three composite tubes 890, 740, 1740 (like those shown in FIGS. 5-6C).

The two ducts 10 are connected to each other in an end-to-end arrangement. In FIG. 3, it is to be appreciated that the dimensions of the illustrated sealant beads 305, 315 are not necessarily to scale, but rather are shown with dimensions that enable their illustration. Similarly, the resulting gaps between the confronting butt ends of the two ducts are not necessarily to scale, but rather are shown with dimensions that enable illustration of the sealant beads 305, 315.

The first duct 10 and the second duct 10 are joined together by a connection characterized by the male detent of the first duct being received in the female detent of the second duct. In the embodiment of FIG. 3, the exterior metal wall 100 of the inner composite tube 890 of the first duct 10 is nested inside, so as to contact, the interior metal wall 60 of the outer composite tube 740 of the second duct 10.

The connection preferably includes a radial inner interface, an axial interface, and a radial outer interface. The axial interface desirably extends between the radial inner interface and the radial outer interface. In the embodiment of FIG. 3, the radial inner interface is located between the primary foam wall 80 of the inner composite tube 890 of the first duct 10 and the primary foam wall 80 of the inner composite tube 890 of the second duct 10. Preferably, sealant 305 is provided at the radial inner interface. With continued reference to the embodiment of FIG. 3, the axial interface comprises contact between the exterior metal wall 100 of the inner composite tube 890 of the first duct 10 and the interior metal wall 60 of the outer composite tube 740 of the second duct 10. In the embodiment of FIG. 3, the radial outer interface is located between the secondary foam wall 40 of the outer composite tube 740 of the first duct 10 and the secondary foam wall 40 of the outer composite tube 740 of the second duct 10. Preferably, sealant 315 is provided at the radial outer interface.

Figure 6A:
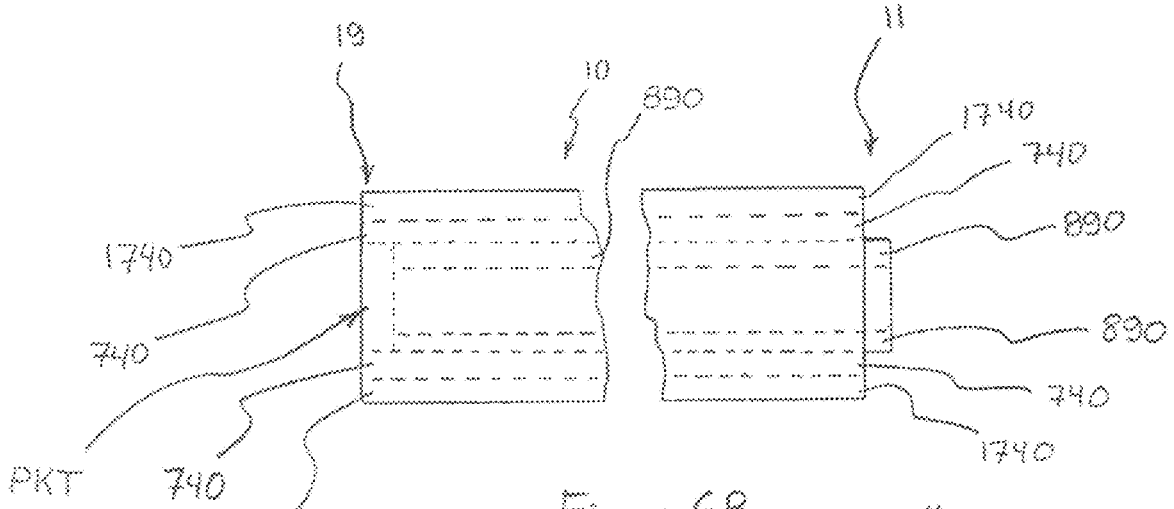
FIG. 6A is a schematic broken-away side view of the duct of FIG. 5.
Figure 6B:
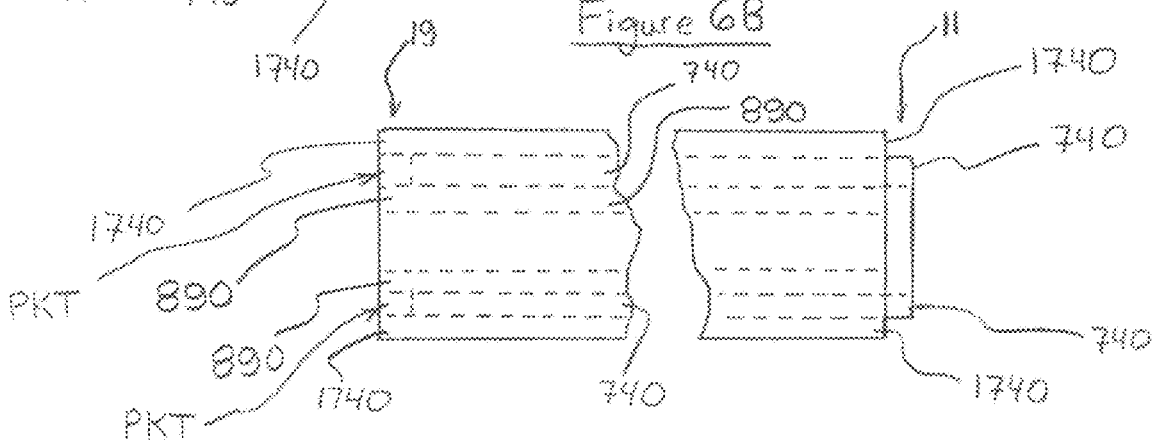
FIG. 6B is a schematic broken-away side view of a duct in accordance with another embodiment of the invention.

Thus, the connection preferably includes first 305 and second 315 beads of sealant. In the embodiment of FIG. 6B, it may be desirable to provide three beads of sealant. In the foregoing embodiments, high performance silicone sealant can be used. Suitable sealant of this nature is available commercially from PAL System International FZCO, of Dubai, U.A.E. Preferably, each bead of sealant is continuous. As shown in FIG. 3, the first 305 and second 315 sealant beads preferably are positioned at locations that are spaced apart both axially and radially. In the embodiment illustrated, for example, the first bead of sealant 305 is located at the radial inner interface, and the second bead of sealant 315 is located at the radial outer interface.

In the method of connecting the two ducts 10 shown in FIG. 3, two beads of sealant are applied respectively on the projecting end of the inner composite tube 890 and on the projecting end of the outer composite tube 740. The male end of the first duct 10 is then pressed into the female end of the second duct 10. The two ducts 10 will seat and seal with a moderate amount of pressure. This will result in a male-female style connection characterized by an end region of the outer composite tube 740 of the second duct 10 overlapping an end region of the inner composite tube 890 of the first duct 10. While the desired overlap dimension can be varied to accommodate different applications, the overlap dimension preferably is in the range of 1 inch to five inches, such as 2-4 inches. In one non-limiting example, the overlap is about 3 inches. In some cases, a rubber mallet or another tool is then used to tap tiger clips (or other suitable fasteners) into both ducts to further secure the connection. UL181 tape is preferably then applied over the tiger clips and the connection (or "duct seam"). Half the width of the tape preferably is on each side of the duct seam. It may be desirable to have the overlap of the tape be on the bottom, or a side, of the duct. If it is on a side of the duct, however, it may be desirable that the overlap face down to maximize water shedding. Next, a squeegee is advantageously used to apply friction to the tape, thereby fully sealing the tape to the duct. An exterior jacketing tape can optionally then be applied over the UL181 tape, tiger clips, and connection/duct seam. Half the width of the jacketing tape is desirably on each side of the duct seam. This jacketing tape can, for example, be 3M™ VentureClad™ 1577 CW Insulation Jacketing Tape. The overlap of the jacketing tape preferably is on the bottom, or a side, of the duct. If it is on a side, it may be desirable that the overlap face down to maximize water shedding. Finally, a squeegee is advantageously used to apply pressure to the jacketing tape, thereby fully adhering the adhesive of the jacketing tape to the duct. It is to be appreciated that while this method is preferred, the foregoing details are by no means required in all embodiments.

In certain embodiments, the invention provides a building 300 provided with an outdoor ductwork system. In these embodiments, the ductwork system is exposed to periodic contact with rain (and in some cases, also snow and hail). In certain embodiments of this nature, the building 300 has a roof 350 and at least part of the outdoor ductwork system is mounted on the roof. Reference is made to FIG. 4. In other embodiments, the outdoor ductwork system is mounted on the ground and/or mounted to one or more sides of the building 300.

The ductwork system includes a series of ducts 10, including a first duct 10 and a second duct 10. These two ducts 10 each have a multi-tube, multi-wall construction of the nature described above. The two ducts 10 are joined together by a connection characterized by the male detent of the first duct being received in the female detent of the second duct. The resulting connection is in accordance with the descriptions set forth in the present disclosure.

In the embodiment of FIG. 4 and other roof-top embodiments, the outdoor ductwork system on the building 300 includes a plurality of anchored duct supports 200 that are attached to the roof 350. With reference to FIG. 4, each anchored duct support 200 includes a top frame, a bottom frame, a left frame, and a right frame. These frames collectively surround an entire outer duct perimeter. The anchored duct supports 200 preferably are devoid of fasteners that penetrate into the ducts 10 they support.

The present duct 10 is by no means required to be used as part of an outdoor ductwork system. In other embodiments, the duct 10 is intended to be used as part of an indoor ductwork system.

FIG. 5 exemplifies embodiments of the invention wherein the HVAC duct 10 includes three composite tubes of the nature described above. In more detail, the HVAC duct 10 of the present embodiments includes an inner composite tube 890, an outer composite tube 740, and an outermost composite tube 1740. The inner composite tube 890 has an interior metal wall 90, a primary foam wall 80, and an exterior metal wall 100. The primary foam wall 80 is bonded to both the interior 90 and exterior 100 metal walls of the inner composite tube 890. The outer composite tube 740 has an interior metal wall 60, a secondary foam wall 40, and an exterior metal wall 70. The secondary foam wall 40 is bonded to both the interior 60 and exterior 70 metal walls of the outer composite tube 740. The outermost composite tube 1740 has an interior metal wall 600, a tertiary foam wall 400, and an exterior metal wall 700. The tertiary foam wall 400 is bonded to both the interior 600 and exterior 700 metal walls of the outermost composite tube 1740.

As with embodiments where the duct 10 has only two composite tubes of the described nature, the inner 890 and outer 740 composite tubes in FIG. 5 are affixed to each other, such that one is nested inside the other, in an end-offset configuration. Specifically, in the embodiment of FIG. 5, the inner composite tube 890 is nested inside the outer composite tube 740 in an end-offset configuration characterized by the inner composite tube projecting axially beyond the outer composite tube at the first end 11 of the duct 10, whereas at the second end 19 of the duct the outer composite tube projects axially beyond the inner composite tube. Thus, in the embodiment of FIG. 5, the first end 11 of the duct 10 defines a male detent having a radially-outward-facing metal engagement face 82 projecting axially beyond the interior metal wall 60 of the outer composite tube 740, whereas the second end 19 of the duct defines a female detent having a radially-inward-facing metal engagement face 42 projecting axially beyond the exterior metal wall 100 of the interior composite tube 890.

In the embodiment of FIG. 5, the outer composite tube 740 is nested inside the outermost composite tube 1740 in a flush-end configuration characterized by those two composite tubes being generally flush with each other at both the first 11 and second 19 ends of the duct 10. In more detail, at each end 11, 19 of this illustrated duct 10, the ends of the outer 740 and outermost 1740 composite tubes are substantially flush with each other.

In certain other embodiments involving three composite tubes, the outer composite tube 740 projects beyond both the inner 890 and outermost 1740 composite tubes at the first end 11 of the duct 10. Reference is made to FIG. 6B. In these embodiments, the inner 890 and outer 740 composite tubes are affixed to each other, such that one is nested inside the other, in an end-offset configuration. Specifically, the inner composite tube 890 is nested inside the outer composite tube 740 in an end-offset configuration characterized by the outer composite tube projecting axially beyond the inner composite tube at the first end 11 of the duct 10, whereas at the second end 19 of the duct the inner composite tube projects axially beyond the outer composite tube. In addition, the outer composite tube 740 is nested inside the outermost composite tube 1740 in an end-offset configuration characterized by the outer composite tube 740 projecting axially beyond the outermost composite tube 1740 at the first end 11 of the duct 10, whereas at the second end 19 of the duct the outermost composite tube projects axially beyond the outer composite tube. In these embodiments, the first end 11 of the duct 10 defines a male detent, whereas the second end 19 of the duct defines a female detent.

In the present embodiments, the male detent (defined by the outer composite tube 740) at the first end 11 of the duct 10 has both a radially-outward-facing metal engagement face (defined by metal wall 70) and a radially-inward-facing metal engagement face (defined by metal wall 60). The radially-outward-facing metal engagement face projects axially beyond the interior metal wall 600 of the outermost composite tube 1740, and the radially-inward-facing metal engagement face projects axially beyond the exterior metal wall 90 of the inner composite tube 890. In these embodiments, the female detent at the second end 19 of the duct 10 has both a radially-inward-facing metal engagement face (defined by metal wall 600) and a radially-outward facing engagement face (defined by metal wall 100).

In still other embodiments involving three composite tubes, the outermost composite tube 1740 projects axially beyond the outer 740 and inner 890 composite tubes at the first end 11 of the duct 10. In these embodiments, the outer 740 and outermost 1740 composite tubes are affixed to each other, such that one is nested inside the other, in an end-offset configuration. Specifically, the outer composite tube 740 is nested inside the outermost composite tube 1740 in an end-offset configuration characterized by the outermost composite tube projecting axially beyond the outer composite tube at the first end 11 of the duct 10, whereas at the second end 19 of the duct the outer composite tube projects axially beyond the outermost composite tube. Preferably, the inner composite tube 890 is nested inside the outer composite tube 740 in a flush-end configuration characterized by those composite tubes being generally flush with each other at both the first 11 and second 19 ends of the duct 10. In such cases, at each end 11, 19 of the duct 10, the ends of the inner 890 and outer 740 composite tubes are substantially flush with each other.

Figure 6C:
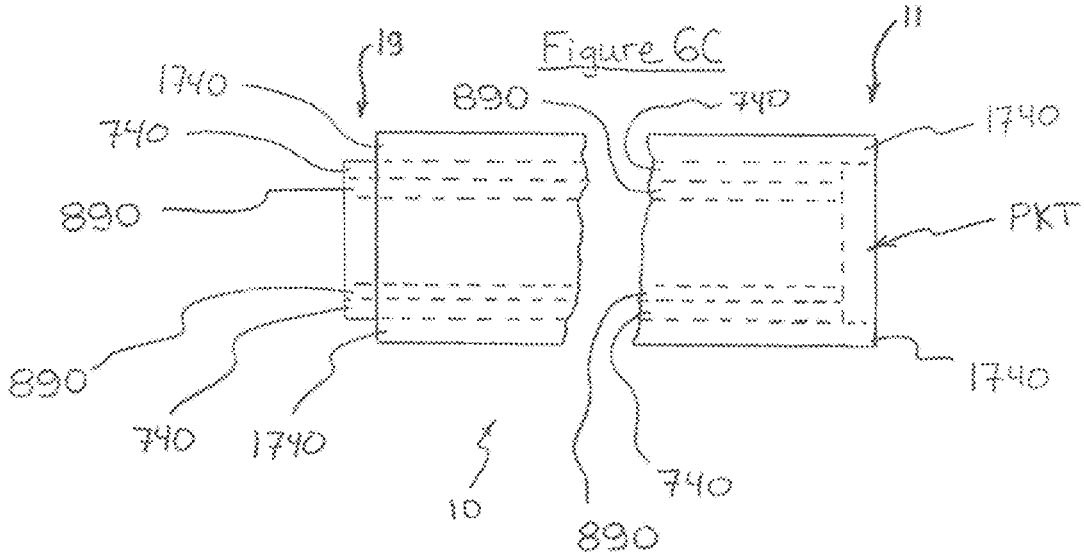
FIG. 6C is a schematic broken-away side view of a duct in accordance with still another embodiment of the invention.

Thus, the invention provides a variety of embodiments wherein an HVAC duct 10 comprises three composite tubes 890, 740, 1740. In these embodiments, the inner composite tube 890 is nested inside the outer composite tube 740, and the outer composite tube is nested inside the outermost composite tube 1740. In more detail, the three composite tubes 890, 740, 1740 are secured in an end-offset configuration characterized by a desired one of the three composite tubes projecting axially beyond the other two of the three composite tubes at the first end 11 of the duct 10, whereas at the second end 19 of the duct the other two of the three composite tubes project axially beyond the desired one of the three composite tubes. Reference is made to FIGS. 6A-6C, which depict three embodiments of this nature. In these three figures, for ease of illustration, the different walls (i.e., the foam and metal walls) of the composite tubes are not shown independently.

In the present embodiments, a leading one of the first 11 and second 19 ends of the duct 10 defines a male detent (the end defining the male detent is referred to herein as the "leading" end of the duct), while a trailing one of the first and second ends of the duct defines a female detent (the end defining the female detent is referred to herein as the "trailing" end of the duct). Preferably, the male detent includes a radially-outward-facing metal engagement face (defined by metal wall 100 in FIGS. 5 and 6A, defined by metal wall 70 in FIGS. 6B and 6C), and the female detent includes a radially-inward-facing metal engagement face (defined by metal wall 60 in FIGS. 5 and 6A, defined by metal wall 600 in FIGS. 6B and 6C).

With continued reference to FIGS. 5 and 6A-6C, it can be appreciated that the female detent includes an axially-outward-facing open pocket PKT surrounded by the radially-inward-facing metal engagement face. In the embodiments of FIGS. 5, 6A, and 6C, the pocket PKT has a circular cross-sectional configuration (i.e., in a cross section taken perpendicular to axis A). In the embodiment of FIG. 6B, the pocket PKT has an annular cross-sectional configuration.

In the present embodiments, two of the three composite tubes 890, 740, 1740 preferably are in flush-end positions characterized by those two composite tubes being substantially flush with each other at both the first 11 and second 19 ends of the duct 10. In the embodiment of FIGS. 5 and 6A, for example, the outer 740 and outermost 1740 composite tubes are in flush-end positions. That is, these two composite tubes are substantially flush with each other at both the first 11 and second 19 ends of the duct 10. In the embodiment of FIG. 6B, the inner 890 and outermost 1740 composite tubes are in flush-end positions, i.e., these two composite tubes are substantially flush with each other at both the first 11 and second 19 ends of the duct 10. In the embodiment of FIG. 6C, the inner 890 and outer 740 composite tubes are in flush-end positions. Thus, these two composite tubes are substantially flush with each other at both the first 11 and second 19 ends of the duct 10.

In the foregoing embodiments involving an HVAC duct 10 having three composite tubes 890, 740, 1740, the duct can be provided as part of an HVAC ductwork assembly that further includes another duct of the nature described above. In such cases, the two ducts (i.e., the "first" and "second" ducts) can advantageously be joined together by a connection characterized by the male detent being received in the female detent. This involves the radially-outward-facing metal engagement face of the male detent being nested inside, so as to contact, the radially-inward-facing metal engagement face of the female detent.

In the embodiments described above, the foam walls of the duct 10 may initially be exposed at both ends of the duct (i.e., a foam end face may be exposed at each end of each foam wall). To protect the foam end faces at each end of the duct, UL181 tape can be applied so as to cover both the male and female ends of the duct 10. This can advantageously leave all the foam concealed.

The present disclosure also provides various ductwork railing embodiments. Reference is made to FIGS. 8-18. Turning first to FIGS. 8-11, there is shown one non-limiting example of a duct 10 in accordance with the present embodiments. The illustrated duct 10 is a pre-insulated duct comprising a tube having a foam layer. This preferably is the case in all the ductwork railing embodiments of the present disclosure. Preferably, the tube has a square or otherwise rectangular configuration, i.e., in a cross-section taken perpendicular to the longitudinal axis A of the duct. Alternatively, the tube can have a circular configuration. Other tube configurations may also be used.

The foam layer of the tube preferably is sandwiched between two skin layers (or "facing" layers), which can optionally be thin metal walls formed of aluminum or another metal. In other cases, such skin layers or other walls are formed of polymer. Alternatively, various composites or other materials may be used. While the two skin layers of the tube may have the same thickness, this is by no means required. When provided, each skin layer preferably has a thickness of between 10 micrometers and 2,600 micrometers, such as between 15 micrometers and 300 micrometers.

In cases where the duct includes two tubes each having a foam core sandwiched between two skin layers, each skin layer can optionally have a thickness within one or both of the ranges noted in this paragraph. In such cases, the skin layers may, or may not, all have the same thickness.

If desired, the pre-insulated duct can comprise inner and outer tubes that each have a foam layer and that are arranged concentrically one inside the other. In such cases, there are at least two foam layers (i.e., at least two thicknesses of foam) between the inner 5 and outer 7 faces of the pre-insulated duct 10. When provided, the inner and outer tubes can optionally be inner 890 and outer 740 composite tubes of the nature previously described and shown in FIGS. 1-3. Thus, the features described previously (for inner 890 and outer 740 composite tubes) and shown in FIGS. 1-3 can optionally be provided in embodiments where the present pre-insulated duct 10 has inner and outer composite tubes. This, however, is not required. For example, the pre-insulated duct 10 can alternatively have inner and outer tubes of different configurations or compositions, and/or made by different methods, than those described above with respect to FIGS. 1-3. Furthermore, if desired, the pre-insulated duct 10 of the present embodiments can comprise three tubes each having a foam layer. Reference is made to the non-limiting examples described previously and shown in FIGS. 5-6C. Thus, the features described previously and shown in any of FIGS. 5-6C can optionally be provided in embodiments where the present pre-insulated duct 10 has three tubes.

Further, it is to be appreciate that in the present embodiments (e.g., any of those shown in FIGS. 8-18), the pre-insulated duct 10 can alternatively have only a single tube (i.e., it can have a mono-tube construction), and that tube can optionally have only a single layer (or "thickness") of foam. Thus, in certain embodiments, the pre-insulated duct has only a single layer (or "thickness") of foam.

The pre-insulated duct 10 preferably has a square or otherwise rectangular configuration, i.e., in a cross-section taken perpendicular to the longitudinal axis A of the duct. In other cases, however, the pre-insulated duct has a circular configuration. Various other duct shapes can alternatively be used.

The pre-insulated duct 10 has an interior face 5 and an exterior face 7. The thickness T of the duct 10 is defined as the distance between the interior face 5 and the exterior face 7. The interior face 5 of the pre-insulated duct 10 bounds an airflow space (e.g., an airflow channel). Preferably, the airflow space extends along the entire length of the duct 10 (e.g., such that the duct is open on both ends, i.e., has two opposed open ends between which the airflow space extends entirely).

In the present embodiments, the pre-insulated duct 10 has a mounting rail system 20 extending along the length of the pre-insulated duct. The mounting rail system includes at least one mounting rail, and preferably includes a plurality of mounting rails, positioned on (e.g., positioned on an exterior of) the pre-insulated duct. In many cases, the mounting rail system 20 comprises a plurality of mounting rails 20 on a plurality of sides (i.e., on the exterior of a plurality of sides) of the pre-insulated duct 10. Preferably, the mounting rail or rails 25 of the mounting system 20 are an exterior of the duct 10, and in many cases (optionally in any embodiment of the present group) the duct will be mounted at an outdoor location, such as on a roof of a building. In such cases, the mounting rail or rails 25 of the mounting system 20 will typically be exposed to an outdoor environment, e.g., exposed to periodic contact with rain.

In FIGS. 8-11, the illustrated duct 10 comprises four sides (i.e., either has four sides only, or has at least four sides) and has two opposed open ends. Here, the mounting rail system 20 has mounting rails 25 that are positioned on (i.e., positioned on the exterior of) only two of the four sides of the pre-insulated duct. The other two sides of the duct (i.e., the exterior of the other two sides of the duct) are devoid of mounting rails. In such cases, on each of the two sides where one or more mounting rails 25 are located, there is preferably only a single mounting rail line extending along the length of the pre-insulated duct 10. Each such single mounting rail line either consists of a single length of mounting rail or comprises two or more lengths of mounting rail positioned in series (optionally so as to be spaced apart from each other along the length of the duct). In these cases, the duct does not include (i.e., is devoid of) two side-by-side laterally spaced apart mounting rails. Instead, there is only a single mounting rail line on each of the two noted sides of the duct. Reference is made to the embodiments of FIGS. 8-11.

Figure 13:
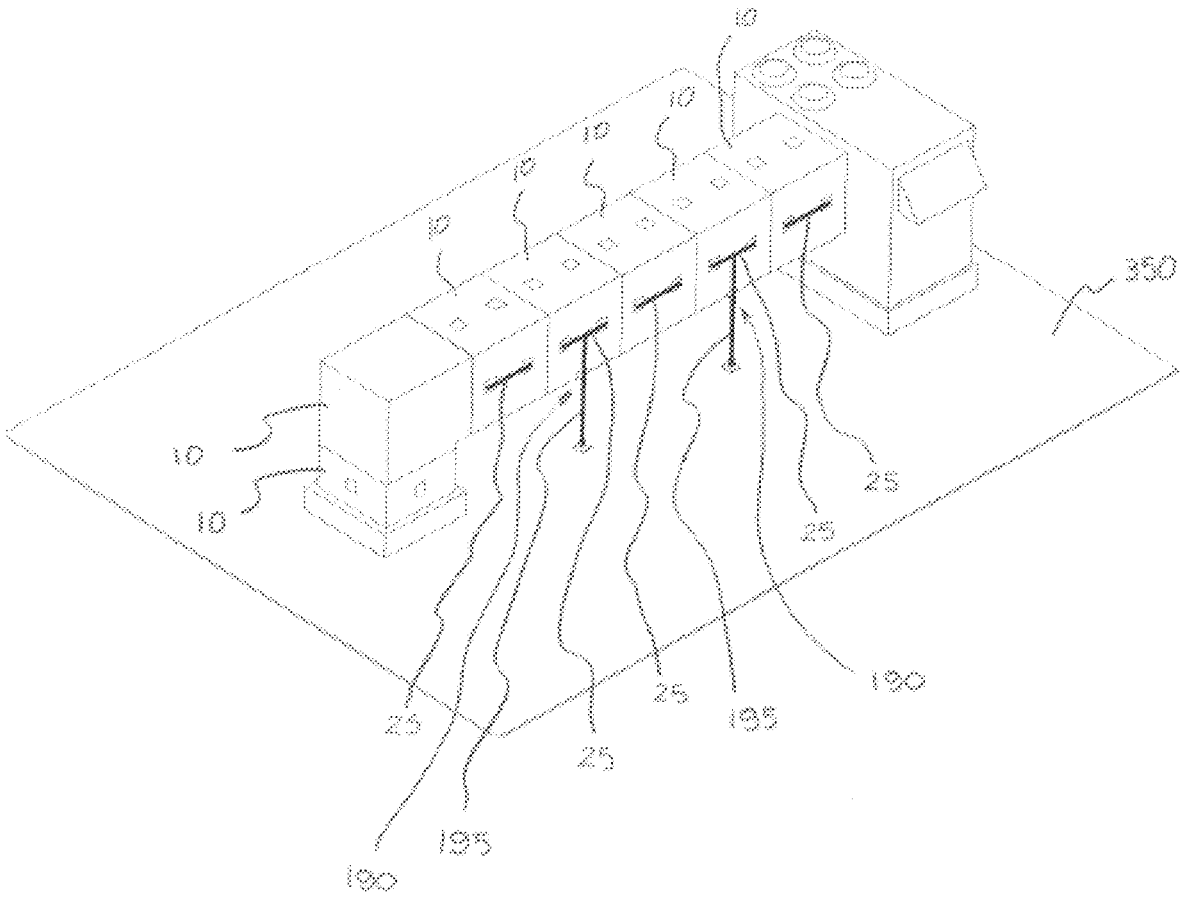
FIG. 13 is a perspective view of a ductwork assembly in accordance with certain embodiments.

In FIGS. 8-11, the two sides on which the mounting rails are positioned are opposed (or "opposite") sides of the pre-insulated duct. Preferably, these two sides are lateral sides of the duct (i.e., sides that will be vertical, or at least substantially vertical, when the duct is installed in its operative position). Reference is made to FIG. 13. Thus, in certain embodiments, the pre-insulated duct 10 has top and bottom sides that are devoid of mounting rails.

It is to be appreciated that the mounting rails of a given mounting rail line need not be directly aligned with one another. For example, referring to FIG. 13, while all five of the illustrated mounting rails 25 are positioned at the same height, this is not required. In some cases, it may be beneficial to position one rail at a first height on a duct while positioning a second rail at a different height on the same duct (or on an adjacent duct). Additionally or alternatively, the rails of a given mounting rail line may be positioned at different angles.

Further, in embodiments like that shown in FIG. 13, a plurality of pre-insulated ducts 10 are connected end-to-end in series as part of a ductwork assembly. The ductwork assembly can include an internal airflow channel formed collectively by the aligned airflow spaces of the individual pre-insulated ducts 10 of the ductwork assembly. In embodiments of this nature, a mounting rail line can extend along a first side (e.g., a first lateral side) of the ductwork assembly, as shown in FIG. 13. Another mounting rail line can extend along another side of the ductwork assembly, preferably along an opposite side, such as an opposite lateral side as shown in FIG. 13. Here, the top and bottom sides of the ductwork assembly can optionally be devoid of mounting rails.

FIG. 13 is representative of ductwork assembly embodiments wherein some, but not all, of the pre-insulated ducts 10 have mounting rails 25. In this particular embodiment, the ductwork assembly includes an elbow-shaped pre-insulated duct 10, as well as a vertical pre-insulated duct 10 below the elbow-shaped pre-insulated duct 10, and neither have mounting rails 25.

Figure 8:
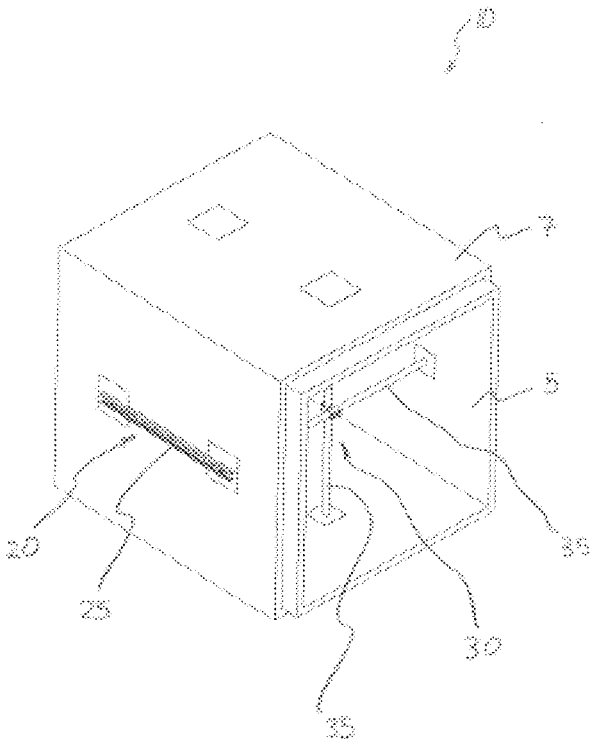
FIG. 8 is a perspective view of another duct in accordance with certain embodiments.
Figure 9:
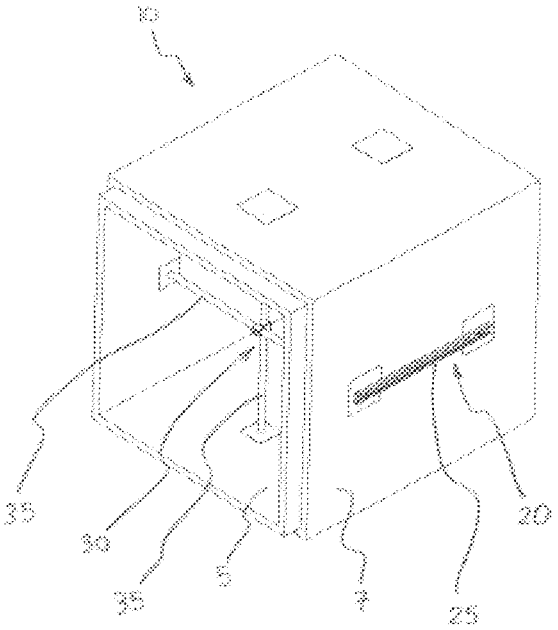
FIG. 9 is another perspective view of the duct of FIG. 8.
Figure 10:
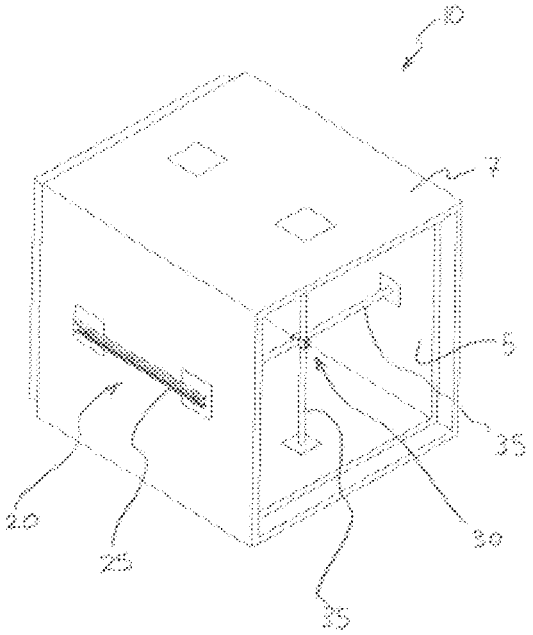
FIG. 10 is still another perspective view of the duct of FIG. 8.
Figure 11:
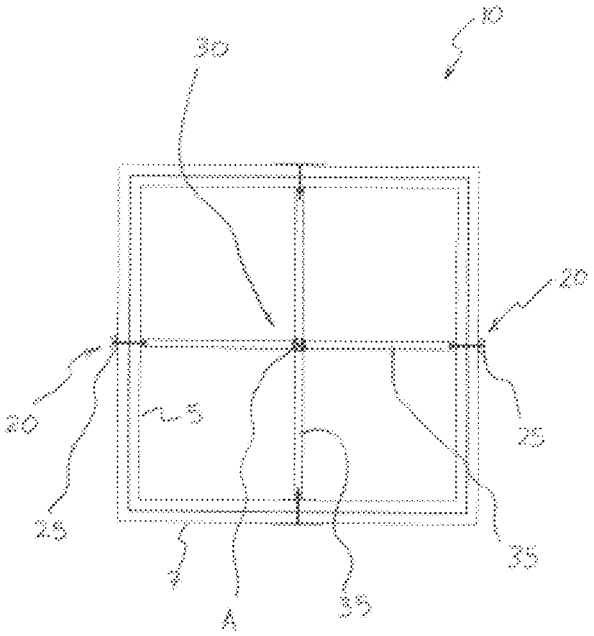
FIG. 11 is an end view of the duct of FIG. 8.

In some embodiments, each duct side that is equipped with the mounting rail system 20 has only a single mounting rail 25 thereon. Reference is made to FIGS. 8 and 9. This, however, is by no means required. For example, each single mounting rail 25 shown in FIGS. 8 and 9 can alternatively be replaced with two or more mounting rails forming a single mounting rail line.

In the embodiment of FIGS. 8-11, the tube is centered on a longitudinal axis (i.e., the longitudinal axis of the duct) on which both of the opposed open ends of the duct are also centered. In addition, each of the mounting rails 25 shown in FIGS. 8-11 is positioned so as to be (e.g., so as to have its length) at least generally parallel to the longitudinal axis of the duct. In some cases, it will be preferable to have the mounting rails 25 parallel, or at least substantially parallel, to the longitudinal axis of the pre-insulated duct 10. In other cases, however, it may be desirable to provide one or more mounting rails of the mounting rail system at other angles. Thus, any given mounting rail on any given pre-insulated duct of the present disclosure can be positioned at any desired angle (even perpendicular to the longitudinal axis of the duct).

Figure 12:
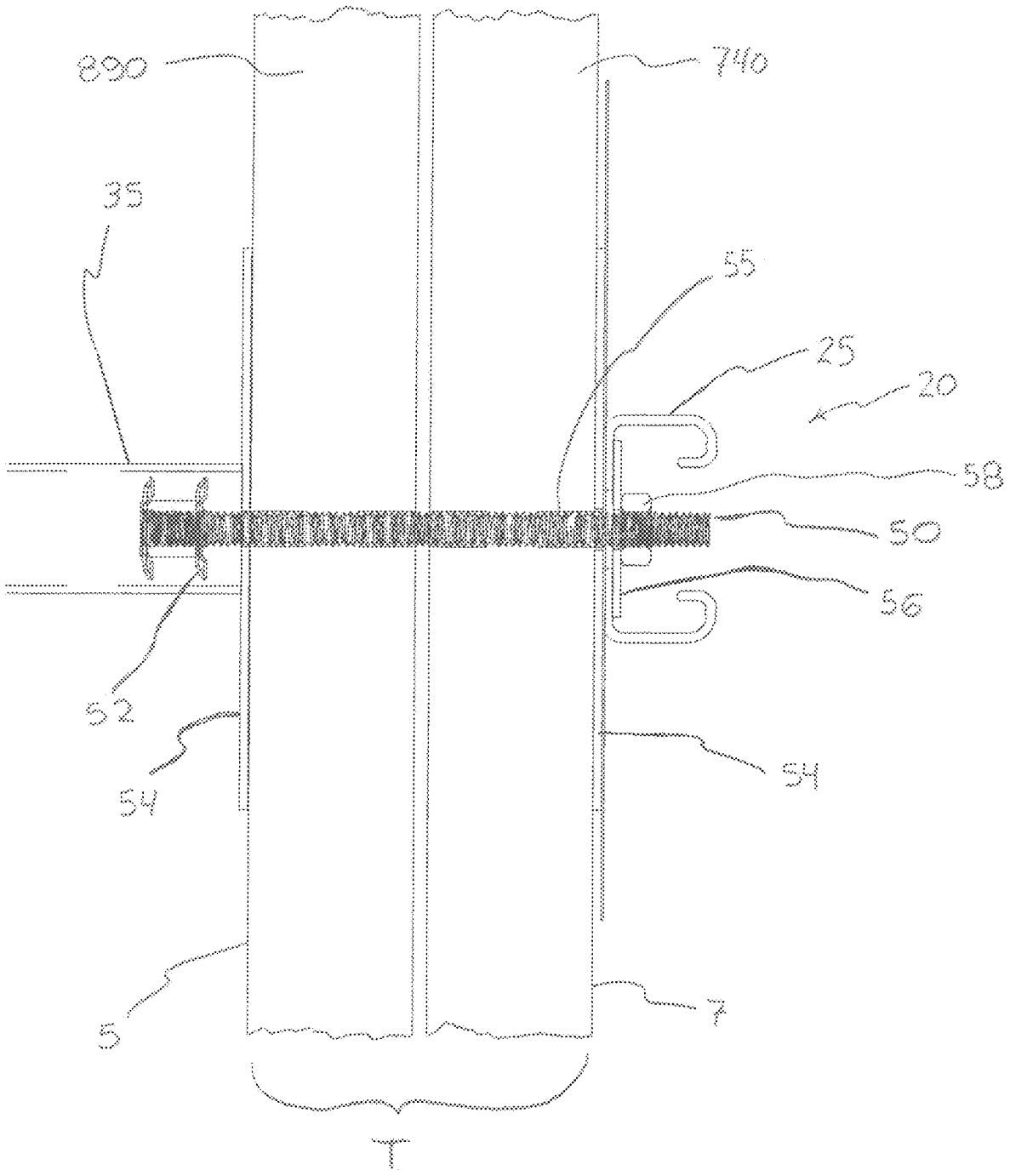
FIG. 12 is a detail view of a connection assembly between a mounting rail and an internal brace of the duct of FIG. 8.

The mounting rails 25 of the mounting rail system 20 preferably comprise (e.g., are) channel bars. In such cases, each mounting rail 25 has a channel configuration. Thus, as best shown in FIG. 12, the mounting rail 25 preferably a generally U-shaped cross-sectional configuration, including a base wall and two side walls upstanding from the base wall. In such cases, the mounting rail 25 has a channel extending along the length of the mounting rail. The two side walls preferably have flanges bent inwardly, e.g., generally toward each other, and optionally also bent toward the base wall. It is to be appreciated that the inwardly turned flanges of the side walls can have different shapes. In other cases, the side walls may be devoid of inwardly turned flanges.

The mounting rails 25 preferably are formed of metal, although fiberglass or plastic may alternatively be used. Channel bars suitable for use as the present mounting rails can be obtained commercially from a variety of well-known metal framing manufacturers and other sellers. One example is Unistrut, of Harvey, Ill., USA.

In the present embodiments, the pre-insulated duct 10 preferably has a plurality of internal braces 30. When provided, the internal braces 30 are located in the airflow space (i.e., in the interior channel) of the duct 10 and preferably are spaced-apart from one another along the length of the duct. In such cases, each of the mounting rails 25 preferably is coupled with (e.g., attached to) the plurality of internal braces 30 at locations spaced-apart along the length of the duct 10. In the embodiment of FIGS. 8-11, the illustrated duct 10 has two internal braces 30 spaced apart from each other along the length of the duct. It is to be appreciated, however, that the number of internal braces 30 provided for the duct 10 will be varied to accommodate different duct sizes (e.g., different widths and lengths) and to suit different applications.

Each illustrated internal brace 30 comprises first and second rods 35 that are crosswise (e.g., perpendicular, or at least substantially perpendicular) to each other. If desired, the internal braces can each have two or more horizontal rods and two or more vertical rods. This may be advantageous for larger ducts. Each of the rods preferably are metal rods, optionally formed of aluminum or another aircraft metal. The aircraft metal can be selected from the group consisting of aluminum, titanium, beryllium, magnesium, and alloys comprising one or more of these metals. In other cases, steel may be used. In still other cases, the rods may be formed of polymer or composite.

Thus, each mounting rail 25 on the pre-insulated duct 10 preferably is coupled with (e.g., attached to) a plurality of internal braces 30. In certain preferred embodiments, each mounting rail 25 is attached to a plurality of internal braces 30, at locations spaced-apart along the length of the pre-insulated duct, by a plurality of traversal linkage pins 50. This is perhaps best shown in FIG. 12. When provided, the traversal linkage pins 50 preferably each extend through (e.g., entirely through) the thickness T of the pre-insulated duct 10 so as to project through the foam layer (or foam layers) of the duct. Each traversal linkage pin 50 preferably is: (i) received in a linkage bore 55 formed in the foam layer, and (ii) attached at one end to one of the mounting rails 25 and attached at an opposite end to one of the internal braces 30.

Thus, referring to FIGS. 8-11, it can be appreciated that each internal brace 30 can optionally be coupled with (e.g., attached to) at least two mounting rails 25 of the mounting rail system 20. In some cases, each internal brace 30 is coupled with (e.g., attached to) to two mounting rails 25, but no more than two mounting rails. In addition, those two mounting rails 25 can optionally be on opposed sides of the duct 10, such as opposed lateral sides of the duct.

FIG. 12 depicts one non-limiting example of how a mounting rail 25 can be attached to an internal brace 30. Here, a linkage bore 55 passes entirely through the thickness T of the pre-insulated duct 10. A traversal linkage pin 50 is received in the linkage bore 55 and is attached to the internal brace 30 at one end (the interior end) while being attached to the mounting rail 25 at an opposite end (the exterior end). In terms of the assembly method, the illustrated locking nut 52 is friction fitted into the end of a rod (e.g., a "tie-rod") 35 of the internal brace 30. This is shown schematically in FIG. 12. While not shown in FIG. 12, another locking nut (not shown) is fitted into the opposite end of the illustrated rod 35 in the same way. The internal brace is then mounted inside the duct 10 in the manner shown in FIGS. 8-11. In the non-limiting assembly arrangement of FIG. 12, a removable nut 58 is used to secure the mounting rail 25 on the duct. This is advantageous in that it can enable the mounting rail 25 to be readily removed from the duct. An alternative is to simply use a bolt, such that the head of the bolt (which would be in the same position as nut 58 when assembled) secures the mounting rail on the duct. A washer 56 and reinforcement disks 54 are also shown. While these assembly arrangements and methods are advantageous, they are by no means limiting to the invention. To the contrary, various other assemblies and methods can be used to attach or otherwise couple the mounting rails to a plurality of internal braces inside the duct.

With continued reference to FIG. 12, it can be appreciated that the connection assembly of each mounting rail 25 to each internal brace 30 can optionally consist of metal components. For example, the mounting rail 25, the tie rod 35, and the traversal linkage pin 50 can all be formed of metal. The same can be true of the optional nut 58, washer 56, and reinforcement disks 54. Thus, the pre-insulated duct 10 can optionally comprise a metal skeleton supporting the one or more tubes that each comprise at least one foam layer. It is to be appreciated, however, that in other embodiments, the mounting rail 25 (or other components of the connection assembly) may be formed of polymer or composite.

Turning now to the embodiment of FIG. 13, at least one component at a bottom (e.g., on or projecting from the bottom) of the pre-insulated duct 10 is secured to at least one of the mounting rails 25 of the mounting rail system 20. In FIG. 13, a support leg assembly 190 is secured to at least one of the mounting rails 25 of the mounting rail system 20. Thus, in some embodiments, the pre-insulated duct 10 further includes a support leg assembly 190 that is secured to at least one of the mounting rails 25 of the mounting rail system 20. In such cases, the support leg assembly 190 comprises at least one leg 195. In some cases, the leg 195 projects away from the bottom of the pre-insulated duct 10. In such cases, the leg may thus be configured to support the pre-insulated duct in a raised position above a roof of a building. When provided, the (or each) support leg assembly 190 will typically comprise two legs 195. In some cases, each such leg projects away from the bottom of the pre-insulated duct. In such cases, the two legs may thus be configured to support (or are assembled so as to be supporting) the pre-insulated duct in a raised position above a roof of a building. In other cases, such leg or legs are configured to support (or are assembled so as to be supporting) the pre-insulated duct in a vertical position alongside a wall (e.g., of a building). If desired, one or more leg or legs can be configured to support (or are assembled so as to be supporting) the pre-insulated duct on a grade.

In the embodiment of FIG. 13, the illustrated support leg assemblies 190 have bottom ends that are positioned on a support surface 350. In many cases, the support surface 350 will be the roof of a building. In other cases, the support surface 350 will be the ground, a foundation, or a floor. As illustrated, the bottom end of each leg 195 can optionally have a stand. The stand may, depending on its particular location, as well as the particular application, be attached to the roof or other support surface 350.

Turning now to the embodiments of FIGS. 14-18, at least one component at a top (e.g., on or projecting from the top) of the pre-insulated duct 10 is secured to at least one of the mounting rails 25 of the mounting rail system 20. In FIGS. 14-18, a roof cap 110 is secured to at least one of the mounting rails 25 of the mounting rail system 20. When provided, the roof cap 110 comprises at least one roof panel (which may be part of a roof housing) that is positioned on a top of the pre-insulated duct 10. In some cases, the roof cap entirely conceals an underlying top side wall of the duct. The roof cap, or at least one roof panel thereof, can optionally be formed of metal.

When provided, the roof cap (or least one roof panel thereof) can optionally be positioned at an acute angle relative to a bottom side (e.g., a bottom wall) and/or a top side (e.g., a top wall) of the pre-insulated duct. In such cases, the roof cap is configured to prevent water from accumulating on the top of the duct. In more detail, the roof cap can be configured to shed water (e.g., rain) off the duct. In other embodiments where the roof cap is provided, however, the roof cap may comprise a roof panel that is parallel to a bottom side (e.g., a bottom wall) and/or a top side (e.g., a top wall) of the pre-insulated duct. Such a roof panel may simply be horizontal when the duct is in its operative position. In such case, the roof pane may advantageously be formed of metal.

While the illustrated roof caps define a pitched roof with two angled roof surfaces converging to a roof peak, the roof cap can alternatively be slanted at a single angle across the entire width of the duct.

Figure 16:
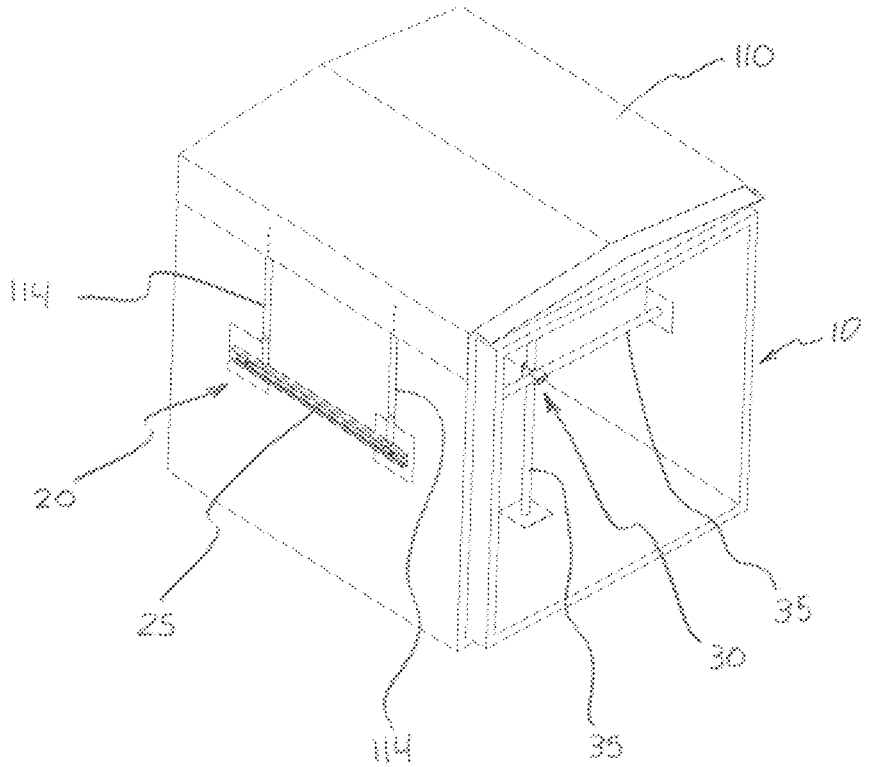
FIG. 16 is a perspective view of yet another duct in accordance with certain embodiments.
Figure 17:
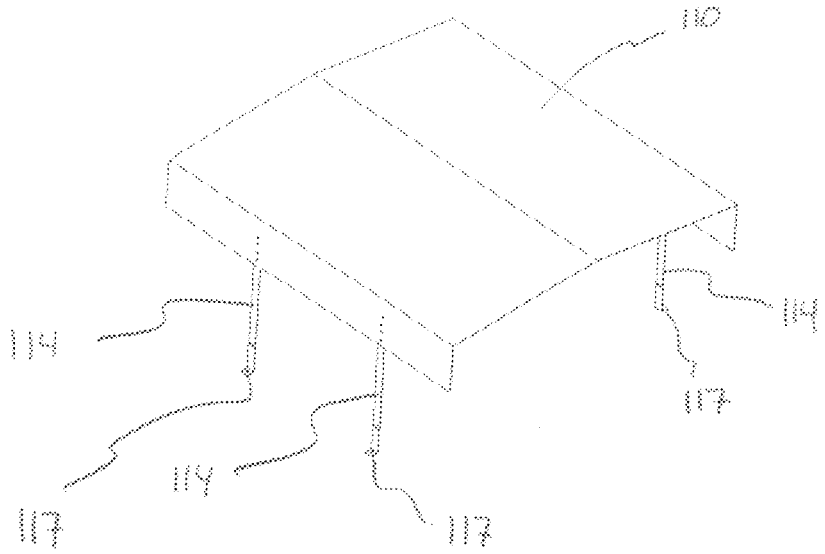
FIG. 17 is a roof cap of the duct of FIG. 16.

In some embodiments where the pre-insulated duct 10 has a roof cap 110, there is at least one attachment strap 114 extending from the roof cap to (and attached to) at least one of the mounting rails 25 of the mounting rail system 20. In such cases, the attachment straps 114 can optionally be formed of metal. In the embodiment of FIGS. 16 and 17, two attachment straps 114 extend from the roof cap 110 to (and are attached to) each mounting rail 25 on the duct 10. Thus, in the non-limiting embodiment of FIG. 16, four attachment straps 114 extend from the roof cap to the two mounting rails 25 on the duct 10. It is to be appreciated, however, that for embodiments involving a roof cap and attachment straps, there can be any number of attachment straps (in some cases, only one attachment strap) connecting the roof cap to each mounting rail on the duct.

Figure 14:
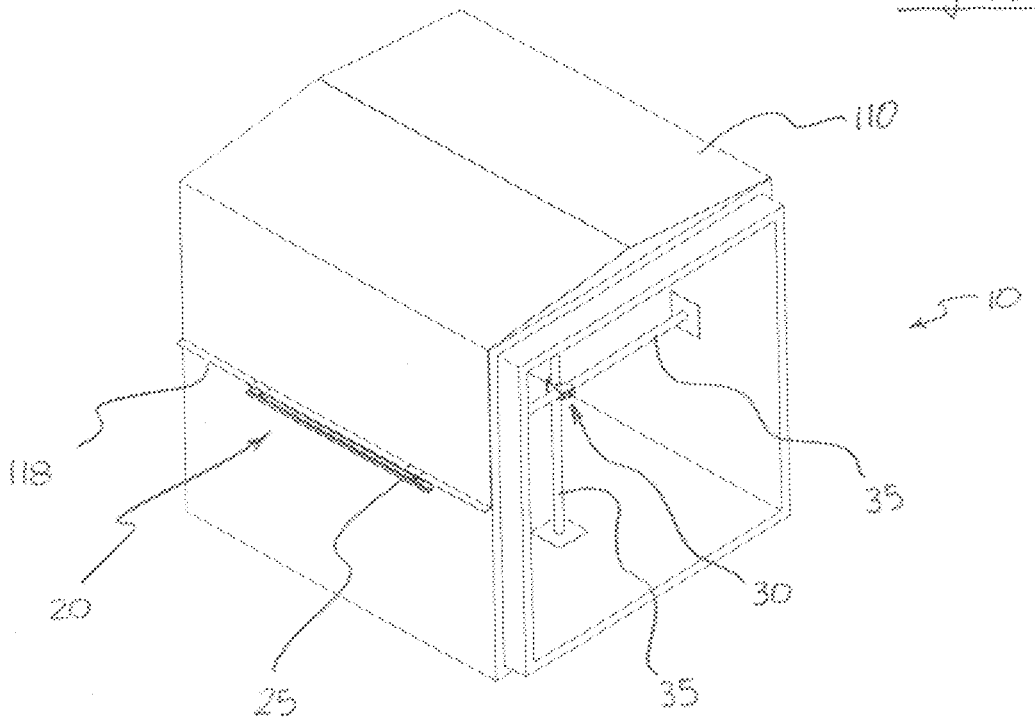
FIG. 14 is a perspective view of still another duct in accordance with certain embodiments.
Figure 15:
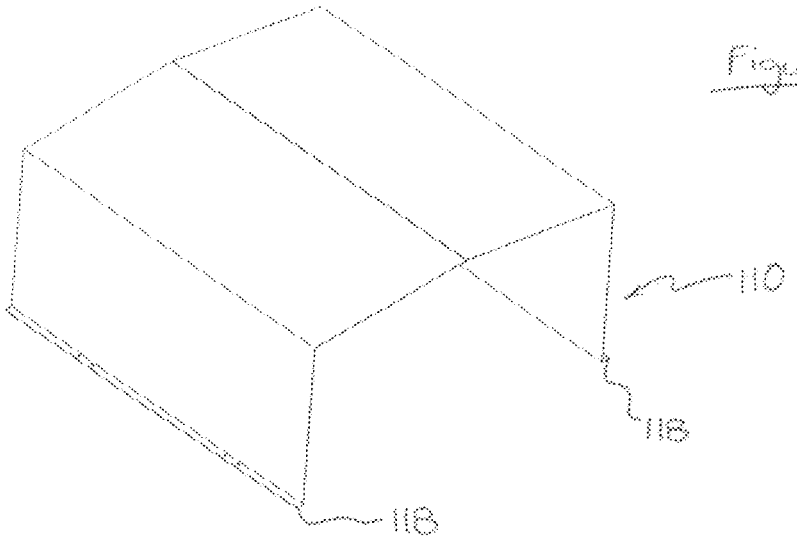
FIG. 15 is a roof cap of the duct of FIG. 14.

FIGS. 14 and 15 depict another embodiment wherein the pre-insulated duct 10 is provided with a roof cap 110. Here, the roof cap 110 has two sidewalls that project away from the angled roof surfaces of the roof cap. As shown in FIG. 14, these two sidewalls are attached respectively to two mounting rails 25 on opposite lateral sides of the duct. In more detail, the illustrated sidewalls each have a mounting flange 118 configured for attachment to a mounting rail 25. One or more fasteners (e.g., bolts) can be extended through holes in each flange 118 and attached to the adjacent mounting rail 25. This is perhaps best appreciated by referring to FIG. 14.

Figure 18:
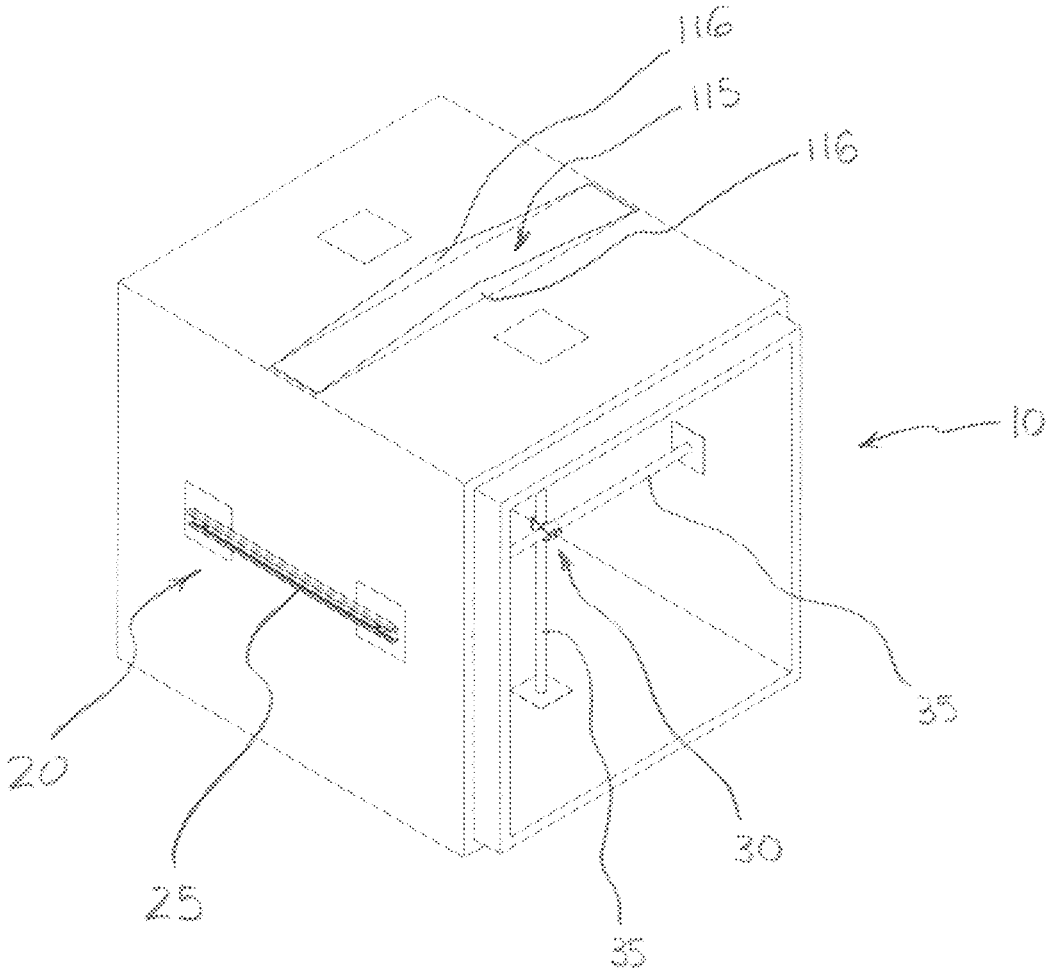
FIG. 18 is a perspective view of the duct of FIG. 16 with the roof cap removed so as to show a roof truss of the duct.

Turning now to FIG. 18, it can be appreciated that the pre-insulated duct 10 can optionally be provided with a roof truss 115. In such cases, the roof truss 115 can be configured to support and/or mount a roof cap 110 on the top of the duct. The roof truss 115 can thus have at least one upright (e.g., vertical or generally vertical) wall 116. The roof truss 115 can advantageously be formed of metal, although certain plastics or composites may also be suitable.

While a single roof truss 115 is shown on the duct 10 of FIG. 18, there can optionally be two or more roof trusses on the top of the duct. When provided, each roof truss 115 preferably is located between a top wall of the duct 10 and a roof cap 100.

Furthermore, in certain embodiments, at least one of the mounting rails 25 of the mounting rail system 20 is attached to both (i) at least one component at a top of the pre-insulated duct, and (ii) at least one component at a bottom of the pre-insulated duct. As noted above, the component at a top of the pre-insulated duct may be, for example, a roof cap 110, while the component at a bottom of the pre-insulated duct may be, for example, a support leg assembly 190. Given the present teaching as a guide, it will be apparent to skilled artisans that other types of components can additionally or alternatively be attached to the mounting rail system 20 of the present disclosure.

With reference again to FIG. 13, this figure shows a ductwork assembly wherein a plurality of pre-insulated ducts 10 have mounting rails 25 and some, but not all, of those particular pre-insulated ducts 10 have components attached to the mounting rails on those particular ducts. Thus, in certain embodiments, the ductwork assembly comprises: (i) one or more pre-insulated ducts 10 that have mounting rails 25 to which one or more components are attached, and (ii) one or more pre-insulated ducts 10 that have mounting rails 25 to which no components (e.g., no support leg assemblies or other framework) are attached.

While some preferred embodiments of the invention have been described, it should be understood that various changes, adaptations and modifications may be made therein without departing from the spirit of the invention and the scope of the appended claims.

What is claimed is:

1. An HVAC duct having opposed first and second ends and a central span extending between the first and second ends, the HVAC duct comprising an inner composite tube and an outer composite tube, the inner composite tube having a length that is no more than 10% different from a length of the outer composite tube, the inner composite tube having an interior metal wall, a primary foam wall, and an exterior metal wall, the primary foam wall being bonded to both the interior and exterior metal walls of the inner composite tube, wherein the interior metal wall and the exterior metal wall of the inner composite tube each have a thickness in a range of between 15 and 300 micrometers, the outer composite tube having an interior metal wall, a secondary foam wall, and an exterior metal wall, the secondary foam wall being bonded to both the interior and exterior metal walls of the outer composite tube, wherein the interior metal wall and the exterior metal wall of the outer composite tube each have a thickness in a range of between 15 and 300 micrometers, the inner composite tube being nested inside the outer composite tube in an end-offset configuration characterized by the inner composite tube projecting axially beyond the outer composite tube at the first end of the duct whereas at the second end of the duct the outer composite tube projects axially beyond the inner composite tube, such that the first end of the duct defines a male detent having a radially-outward-facing metal engagement face projecting axially beyond the interior metal wall of the outer composite tube whereas the second end of the duct defines a female detent having a radially-inward-facing metal engagement face projecting axially beyond the exterior metal wall of the interior composite tube, wherein the inner composite tube nested inside the outer composite tube forms a concentric nesting arrangement wherein the inner composite tube and the outer composite tube both define part of the first end of the duct and both define part of the second end of the duct.

2. The HVAC duct of claim 1 wherein the interior metal wall, the primary foam wall, and the exterior metal wall of the inner composite tube each have substantially the same length, and the interior metal wall, the secondary foam wall, and the exterior metal wall of the outer composite tube each have substantially the same length.

3. The HVAC duct of claim 1 wherein the duct has a weight per unit surface area of less than two pounds per square foot.

4. The HVAC duct of claim 1 wherein the interior and exterior metal walls of the inner composite tube, as well as the interior and exterior metal walls of the outer composite tube, each comprise aluminum, whereas the primary and secondary foam walls each comprise a phenolic resin.

5. The HVAC duct of claim 1 wherein the duct has a length of between 1 and 18 feet.

6. The HVAC duct of claim 1 wherein the inner composite tube and the outer composite tube are affixed to each other so as to be locked against relative axial or rotational movement relative to each other, and the duct has its first and second ends exposed, including the male detent of the duct having its radially-outward-facing metal engagement face exposed.

7. The HVAC duct of claim 1 wherein the primary foam wall and the secondary foam wall each have a thickness in a range of 10-100 mm.

8. The HVAC duct of claim 1 wherein the primary foam wall and the secondary foam wall each have a thickness in a range of 15-60 mm.

9. The HVAC duct of claim 1 wherein the primary foam wall and the secondary foam wall are formed by foam layers that are self-supporting and rigid and thus not capable of being wound.

10. The HVAC duct of claim 1 wherein the primary foam wall and the secondary foam wall are formed by foam layers that each provide a thermal break, such that there is no thermal pathway connecting the interior metal wall of the inner composite tube with the exterior metal wall of the outer composite tube.

11. The HVAC duct of claim 1 wherein the inner composite tube and the outer composite tube each have a circular configuration in a cross section taken perpendicular to a longitudinal axis of the duct.

12. An HVAC duct having opposed first and second ends and a central span extending between the first and second ends, the HVAC duct comprising an inner composite tube and an outer composite tube, the inner composite tube having an interior metal wall, a primary foam wall, and an exterior metal wall, the primary foam wall being bonded to both the interior and exterior metal walls of the inner composite tube, the outer composite tube having an interior metal wall, a secondary foam wall, and an exterior metal wall, the secondary foam wall being bonded to both the interior and exterior metal walls of the outer composite tube, the inner composite tube being nested inside the outer composite tube in an end-offset configuration characterized by the inner composite tube projecting axially beyond the outer composite tube at the first end of the duct whereas at the second end of the duct the outer composite tube projects axially beyond the inner composite tube, such that the first end of the duct defines a male detent having a radially-outward-facing metal engagement face projecting axially beyond the interior metal wall of the outer composite tube whereas the second end of the duct defines a female detent having a radially-inward-facing metal engagement face projecting axially beyond the exterior metal wall of the interior composite tube, wherein the inner composite tube is nested inside the outer composite tube such that the exterior metal wall of the inner composite tube and the interior metal wall of the outer composite tube contact each other.

13. The HVAC duct of claim 12 wherein the inner composite tube and the outer composite tube are affixed to each other so as to be locked against relative axial or rotational movement relative to each other, and the duct has its first and second ends exposed, including the male detent of the duct having its radially-outward-facing metal engagement face exposed.

14. The HVAC duct of claim 12 wherein the interior metal wall and the exterior metal wall of the inner composite tube each have a thickness in a range of between 10 and 2,600 micrometers, and wherein the interior metal wall and the exterior metal wall of the outer composite tube each have a thickness in a range of between 10 and 2,600 micrometers.

15. The HVAC duct of claim 12 wherein the interior metal wall and the exterior metal wall of the inner composite tube each have a thickness in a range of between 15 and 300 micrometers, and wherein the interior metal wall and the exterior metal wall of the outer composite tube each have a thickness in a range of between 15 and 300 micrometers.

16. The HVAC duct of claim 12 wherein the primary foam wall and the secondary foam wall each have a thickness in a range of 10-100 mm.

17. The HVAC duct of claim 12 wherein the primary foam wall and the secondary foam wall each have a thickness in a range of 15-60 mm.

18. The HVAC duct of claim 12 wherein the primary foam wall and the secondary foam wall are formed by foam layers that are self-supporting and rigid and thus not capable of being wound.

19. The HVAC duct of claim 12 wherein the primary foam wall and the secondary foam wall are formed by foam layers that each provide a thermal break, such that there is no thermal pathway connecting the interior metal wall of the inner composite tube with the exterior metal wall of the outer composite tube.

20. The HVAC duct of claim 12 wherein the inner composite tube and the outer composite tube each have a circular configuration in a cross section taken perpendicular to a longitudinal axis of the duct.

21. An HVAC ductwork assembly comprising a first duct and a second duct;

the first duct having opposed first and second ends and a central span extending between the first and second ends, the first duct comprising an inner composite tube and an outer composite tube, the inner composite tube having a length that is no more than 10% different from a length of the outer composite tube, the inner composite tube having an interior metal wall, a primary foam wall, and an exterior metal wall, the primary foam wall being bonded to the interior and exterior metal walls of the inner composite tube, the outer composite tube having an interior metal wall, a secondary foam wall, and an exterior metal wall, the secondary foam wall being bonded to both the interior and exterior metal walls of the outer composite tube, the inner composite tube being nested inside the outer composite tube in an end-offset configuration characterized by the inner composite tube projecting beyond the outer composite tube at the first end of the first duct whereas at the second end of the first duct the outer composite tube projects beyond the inner composite tube, such that the first end of the first duct defines a male detent having a radially-outward-facing metal engagement face projecting axially beyond the interior metal wall of the outer composite tube of the first duct whereas the second end of the first duct defines a female detent having a radially-inward-facing metal engagement face projecting axially beyond the exterior metal wall of the inner composite tube of the first duct, wherein the inner composite tube nested inside the outer composite tube forms a concentric nesting arrangement wherein the inner composite tube and the outer composite tube both define part of the first end of the first duct and both define part of the second end of the first duct;

the second duct having opposed first and second ends and a central span extending between the first and second ends, the second duct comprising an inner composite tube and an outer composite tube, the inner composite tube having a length that is no more than 10% different from a length of the outer composite tube, the inner composite tube having an interior metal wall, a primary foam wall, and an exterior metal wall, the primary foam wall being bonded to the interior and exterior metal walls of the inner composite tube, the outer composite tube having an interior metal wall, a secondary foam wall, and an exterior metal wall, the secondary foam wall being bonded to the interior and exterior metal walls of the outer composite tube, the inner composite tube being nested inside the outer composite tube in an end-offset configuration characterized by the inner composite tube projecting beyond the outer composite tube at the first end of the second duct whereas at the second end of the second duct the outer composite tube projects beyond the inner composite tube, such that the first end of the second duct defines a male detent having a radially-outwardly-facing metal engagement face projecting axially beyond the interior metal wall of the outer composite tube whereas the second end of the second duct defines a female detent having a radially-inwardly-facing metal engagement face projecting axially beyond the exterior metal wall of the inner composite tube, wherein the inner composite tube nested inside the outer composite tube forms a concentric nesting arrangement wherein the inner composite tube and the outer composite tube both define part of the first end of the second duct and both define part of the second end of the second duct;

the first duct and the second duct being joined together by a connection characterized by the male detent of the first duct being received in the female detent of the second duct, the connection including a radial inner interface, an axial interface, and a radial outer interface, the radial inner interface being located between the primary foam wall of the inner composite tube of the first duct and the primary foam wall of the inner composite tube of the second duct, the axial interface being located between the exterior metal wall of the inner composite tube of the first duct and the interior metal wall of the outer composite tube of the second duct, the radial outer interface being located between the secondary foam wall of the outer composite tube of the first duct and the secondary foam wall of the outer composite tube of the second duct, wherein the axial interface extends between the radial inner interface and the radial outer interface, and wherein the connection includes a bead of sealant located at the radial outer interface.

22. The HVAC ductwork assembly of claim 21 wherein the inner composite tube and the outer composite tube of the first duct are affixed to each other so as to be locked against relative axial or rotational movement relative to each other, and wherein the inner composite tube and the outer composite tube of the second duct are affixed to each other so as to be locked against relative axial or rotational movement relative to each other.

23. The HVAC ductwork assembly of claim 21 wherein the interior metal wall and the exterior metal wall of the inner composite tube of the first duct each have a thickness in a range of between 10 and 2,600 micrometers, wherein the interior metal wall and the exterior metal wall of the outer composite tube of the first duct each have a thickness in a range of between 10 and 2,600 micrometers, wherein the interior metal wall and the exterior metal wall of the inner composite tube of the second duct each have a thickness in a range of between 10 and 2,600 micrometers, and wherein the interior metal wall and the exterior metal wall of the outer composite tube of the second duct each have a thickness in a range of between 10 and 2,600 micrometers.

24. The HVAC ductwork assembly of claim 21 wherein the interior metal wall and the exterior metal wall of the inner composite tube of the first duct each have a thickness in a range of between 15 and 300 micrometers, wherein the interior metal wall and the exterior metal wall of the outer composite tube of the first duct each have a thickness in a range of between 15 and 300 micrometers, wherein the interior metal wall and the exterior metal wall of the inner composite tube of the second duct each have a thickness in a range of between 15 and 300 micrometers, and wherein the interior metal wall and the exterior metal wall of the outer composite tube of the second duct each have a thickness in a range of between 15 and 300 micrometers.

25. The HVAC duct of claim 21 wherein the primary foam wall and the secondary foam wall of the first duct each have a thickness in a range of 10-100 mm, and wherein the primary foam wall and the secondary foam wall of the second duct each have a thickness in a range of 10-100 mm.

26. The HVAC duct of claim 21 wherein the primary foam wall and the secondary foam wall of the first duct each have a thickness in a range of 15-60 mm, and wherein the primary foam wall and the secondary foam wall of the second duct each have a thickness in a range of 15-60 mm.

27. The HVAC duct of claim 21 wherein the primary foam wall and the secondary foam wall of the first duct are formed by foam layers that are self-supporting and rigid and thus not capable of being wound, and wherein the primary foam wall and the secondary foam wall of the second duct are formed by foam layers that are self-supporting and rigid and thus not capable of being wound.

28. The HVAC duct of claim 21 wherein the primary foam wall and the secondary foam wall of the first duct are formed by foam layers that each provide a thermal break, such that in the first duct there is no thermal pathway connecting the interior metal wall of the inner composite tube with the exterior metal wall of the outer composite tube, and wherein the primary foam wall and the secondary foam wall of the second duct are formed by foam layers that each provide a thermal break, such that in the second duct there is no thermal pathway connecting the interior metal wall of the inner composite tube with the exterior metal wall of the outer composite tube.

29. The HVAC duct of claim 21 wherein the inner composite tube and the outer composite tube of the first duct each have a circular configuration in a cross section taken perpendicular to a longitudinal axis of the first duct, and wherein the inner composite tube and the outer composite tube of the second duct each have a circular configuration in a cross section taken perpendicular to a longitudinal axis of the second duct.

* * * * *